US008342525B2

(12) United States Patent
Scheper et al.

(10) Patent No.: US 8,342,525 B2
(45) **Date of Patent: *Jan. 1, 2013**

(54) CARD SHUFFLER WITH ADJACENT CARD INFEED AND CARD OUTPUT COMPARTMENTS

(75) Inventors: Paul K. Scheper, Bloomington, MN (US); Attila Grauzer, Las Vegas, NV (US); James V. Kelly, Las Vegas, NV (US); James B. Stasson, Eden Prairie, MN (US); Ronald R. Swanson, Otsego, MN (US); Feraidoon Bourbour, Eden Prairie, MN (US); Troy D. Nelson, Big Lake, MN (US); David B. Lopez, Henderson, NV (US); Mark L. Yoseloff, Henderson, NV (US); R. Brooke Dunn, Henderson, NV (US); Peter Krenn, Wohnpart Kery (AT); Ernst Blaha, Irenetalstrasse (AT)

(73) Assignee: SHFL entertainment, Inc., Las Vegas, NV (US)

( * ) Notice: Subject to any disclaimer, the term of this patent is extended or adjusted under 35 U.S.C. 154(b) by 227 days.

This patent is subject to a terminal disclaimer.

(21) Appl. No.: 11/481,407

(22) Filed: Jul. 5, 2006

(65) Prior Publication Data

US 2008/0006997 A1 Jan. 10, 2008

(51) Int. Cl.
*A63F 1/12* (2006.01)

(52) U.S. Cl. ..... 273/149 R

(58) Field of Classification Search ..... None
See application file for complete search history.

(56) References Cited

U.S. PATENT DOCUMENTS

| | | | |
|---|---|---|---|
| 793,489 | A | 6/1905 | Williams |
| 1,014,219 | A | 1/1912 | Hall |
| 1,885,276 | A | 11/1932 | McKay |
| 2,001,220 | A | 5/1935 | Smith |
| 2,001,918 | A | 5/1935 | Nevius |
| 2,016,030 | A | 10/1935 | Woodruff et al. |
| 2,043,343 | A | 6/1936 | Warner |
| 2,065,824 | A | 12/1936 | Plass |
| 2,254,484 | A | 9/1941 | Hutchins |

(Continued)

FOREIGN PATENT DOCUMENTS

| | | |
|---|---|---|
| WO | WO 87/00764 | 2/1987 |

(Continued)

OTHER PUBLICATIONS http://www.google.com/search?tbm=pts
&q=Card+handling+device+with+input+and+outpu....*

(Continued)

*Primary Examiner* — Alvin Hunter
*Assistant Examiner* — Dolores Collins
(74) *Attorney, Agent, or Firm* — TraskBritt

(57) ABSTRACT

A playing card handling device is disclosed. The device includes a first side and a second opposite side. Components of the device include a card infeed tray, a card output tray and a card handling zone. The card infeed tray and card output tray are on the same first side of the device and an upper surface of the card infeed tray and an upper surface of the card output tray are in the same plane. Card handling devices of the present invention also include a touch screen display, as well as a movable card gate.

21 Claims, 10 Drawing Sheets

U.S. PATENT DOCUMENTS

| | | | | |
|---|---|---|---|---|
| 2,328,153 | A | | 8/1943 | Laing |
| 2,328,879 | A | | 9/1943 | Isaacson |
| 2,364,413 | A | | 12/1944 | Wittel |
| 2,778,644 | A | | 1/1957 | Stephenson |
| 2,937,739 | A | | 5/1960 | Levy |
| 2,950,005 | A | | 8/1960 | MacDonald |
| 3,147,978 | A | | 9/1964 | Sjöstrand |
| 3,235,741 | A | | 2/1966 | Plaisance |
| 3,312,473 | A | | 4/1967 | Friedman et al. |
| 3,595,388 | A | | 7/1971 | Castaldi |
| 3,690,670 | A | | 9/1972 | Cassady et al. |
| 3,716,238 | A | | 2/1973 | Porter |
| 3,897,954 | A | | 8/1975 | Erickson et al. |
| 3,944,230 | A | | 3/1976 | Fineman |
| 4,159,581 | A | | 7/1979 | Lichtenberg |
| 4,232,861 | A | | 11/1980 | Maul |
| 4,361,393 | A | | 11/1982 | Noto |
| 4,368,972 | A | | 1/1983 | Naramore |
| 4,385,827 | A | | 5/1983 | Naramore |
| 4,388,994 | A | | 6/1983 | Suda et al. |
| 4,397,469 | A | | 8/1983 | Carter, III |
| 4,494,197 | A | | 1/1985 | Troy et al. |
| 4,497,488 | A | | 2/1985 | Plevyak et al. |
| 4,512,580 | A | | 4/1985 | Matviak |
| 4,513,969 | A | | 4/1985 | Samsel, Jr. |
| 4,515,367 | A | | 5/1985 | Howard |
| 4,534,562 | A | | 8/1985 | Cuff et al. |
| 4,566,782 | A | | 1/1986 | Britt et al. |
| 4,586,712 | A | | 5/1986 | Lorber et al. |
| 4,659,082 | A | | 4/1987 | Greenberg |
| 4,662,637 | A | | 5/1987 | Pfeiffer |
| 4,667,959 | A | | 5/1987 | Pfeiffer et al. |
| 4,741,524 | A | | 5/1988 | Bromage |
| 4,750,743 | A | | 6/1988 | Nicoletti |
| 4,755,941 | A | | 7/1988 | Bacchi |
| 4,759,448 | A | | 7/1988 | Kawabata |
| 4,770,421 | A | | 9/1988 | Hoffman |
| 4,807,884 | A | | 2/1989 | Breeding |
| 4,822,050 | A | | 4/1989 | Normand et al. |
| 4,832,342 | A | | 5/1989 | Plevyak et al. |
| 4,876,000 | A | | 10/1989 | Mikhail |
| 4,900,009 | A | | 2/1990 | Kitahara et al. |
| 4,926,327 | A | | 5/1990 | Sidley |
| 4,951,950 | A | | 8/1990 | Normand et al. |
| 4,969,648 | A | | 11/1990 | Hollinger et al. |
| 4,995,615 | A | | 2/1991 | Cheng |
| 5,000,453 | A | | 3/1991 | Stevens et al. |
| 5,067,713 | A | | 11/1991 | Soules et al. |
| 5,081,487 | A | * | 1/1992 | Hoyer et al. ..... 355/75 |
| 5,121,192 | A | | 6/1992 | Kazui |
| 5,121,921 | A | | 6/1992 | Friedman et al. |
| 5,179,517 | A | | 1/1993 | Sarbin et al. |
| 5,199,710 | A | | 4/1993 | Lamle |
| 5,209,476 | A | | 5/1993 | Eiba |
| 5,224,712 | A | | 7/1993 | Laughlin et al. |
| 5,240,140 | A | | 8/1993 | Huen |
| 5,257,179 | A | | 10/1993 | DeMar |
| 5,261,667 | A | | 11/1993 | Breeding |
| 5,275,411 | A | | 1/1994 | Breeding |
| 5,276,312 | A | | 1/1994 | McCarthy |
| 5,283,422 | A | | 2/1994 | Storch et al. |
| 5,288,081 | A | | 2/1994 | Breeding |
| 5,303,921 | A | | 4/1994 | Breeding |
| 5,356,145 | A | | 10/1994 | Verschoor |
| 5,362,053 | A | | 11/1994 | Miller |
| 5,374,061 | A | | 12/1994 | Albrecht |
| 5,382,024 | A | | 1/1995 | Blaha |
| 5,382,025 | A | | 1/1995 | Sklansky et al. |
| 5,390,910 | A | | 2/1995 | Mandel et al. |
| 5,431,399 | A | | 7/1995 | Kelley |
| 5,437,462 | A | | 8/1995 | Breeding |
| 5,470,079 | A | | 11/1995 | LeStrange et al. |
| 5,524,888 | A | * | 6/1996 | Heidel ..... 463/22 |
| 5,584,483 | A | | 12/1996 | Sines et al. |
| 5,586,766 | A | | 12/1996 | Forte et al. |
| 5,586,936 | A | | 12/1996 | Bennett et al. |
| 5,605,334 | A | | 2/1997 | McCrea, Jr. |
| 5,613,912 | A | | 3/1997 | Slater |
| 5,651,548 | A | | 7/1997 | French et al. |
| 5,655,961 | A | | 8/1997 | Acres et al. |
| 5,669,816 | A | | 9/1997 | Garczynski et al. |
| 5,676,372 | A | | 10/1997 | Sines et al. |
| 5,681,039 | A | | 10/1997 | Miller |
| 5,683,085 | A | | 11/1997 | Johnson et al. |
| 5,690,324 | A | | 11/1997 | Otomo et al. |
| 5,692,748 | A | | 12/1997 | Frisco et al. |
| 5,695,189 | A | | 12/1997 | Breeding et al. |
| 5,707,287 | A | | 1/1998 | McCrea, Jr. |
| 5,718,427 | A | | 2/1998 | Cranford et al. |
| 5,722,893 | A | | 3/1998 | Hill et al. |
| 5,735,525 | A | | 4/1998 | McCrea, Jr. |
| 5,735,742 | A | | 4/1998 | French |
| 5,772,505 | A | | 6/1998 | Garczynski et al. |
| 5,779,546 | A | | 7/1998 | Meissner et al. |
| 5,781,647 | A | | 7/1998 | Fishbine et al. |
| 5,788,574 | A | | 8/1998 | Ornstein et al. |
| 5,803,808 | A | | 9/1998 | Strisower |
| 5,911,626 | A | | 6/1999 | McCrea, Jr. |
| 5,919,090 | A | * | 7/1999 | Mothwurf ..... 463/25 |
| 5,941,769 | A | | 8/1999 | Order |
| 5,944,310 | A | | 8/1999 | Johnson et al. |
| D414,527 | S | | 9/1999 | Tedham |
| 5,989,122 | A | | 11/1999 | Roblejo |
| 6,019,368 | A | | 2/2000 | Sines et al. |
| 6,039,650 | A | | 3/2000 | Hill |
| 6,068,258 | A | | 5/2000 | Breeding et al. |
| 6,071,190 | A | | 6/2000 | Weiss et al. |
| 6,093,103 | A | | 7/2000 | McCrea, Jr. |
| 6,117,012 | A | | 9/2000 | McCrea, Jr. |
| 6,126,166 | A | | 10/2000 | Lorson et al. |
| 6,127,447 | A | | 10/2000 | Mitry et al. |
| 6,139,014 | A | | 10/2000 | Breeding et al. |
| 6,149,154 | A | * | 11/2000 | Grauzer et al. ..... 273/149 R |
| 6,165,069 | A | | 12/2000 | Sines et al. |
| 6,165,072 | A | | 12/2000 | Davis et al. |
| 6,213,310 | B1 | | 4/2001 | Wennersten |
| 6,217,447 | B1 | | 4/2001 | Lofink et al. |
| 6,250,632 | B1 | | 6/2001 | Albrecht |
| 6,254,096 | B1 | * | 7/2001 | Grauzer et al. ..... 273/149 R |
| 6,254,484 | B1 | | 7/2001 | McCrea, Jr. |
| 6,267,248 | B1 | | 7/2001 | Johnson et al. |
| 6,267,648 | B1 | | 7/2001 | Katayama et al. |
| 6,267,671 | B1 | | 7/2001 | Hogan |
| 6,270,404 | B2 | | 8/2001 | Sines et al. |
| 6,293,864 | B1 | | 9/2001 | Romero |
| 6,299,167 | B1 | | 10/2001 | Sines et al. |
| 6,299,536 | B1 | | 10/2001 | Hill |
| 6,313,871 | B1 | | 11/2001 | Schubert |
| 6,325,373 | B1 | | 12/2001 | Breeding et al. |
| 6,346,044 | B1 | | 2/2002 | McCrea, Jr. |
| 6,361,044 | B1 | | 3/2002 | Block et al. |
| 6,403,908 | B2 | * | 6/2002 | Stardust et al. ..... 209/587 |
| 6,443,839 | B2 | | 9/2002 | Stockdale et al. |
| 6,446,864 | B1 | | 9/2002 | Kim et al. |
| 6,460,848 | B1 | | 10/2002 | Soltys et al. |
| 6,517,435 | B2 | | 2/2003 | Soltys et al. |
| 6,517,436 | B2 | | 2/2003 | Soltys et al. |
| 6,520,857 | B2 | | 2/2003 | Soltys et al. |
| 6,527,271 | B2 | * | 3/2003 | Soltys et al. ..... 273/148 R |
| 6,530,836 | B2 | | 3/2003 | Soltys et al. |
| 6,530,837 | B2 | | 3/2003 | Soltys et al. |
| 6,532,297 | B1 | | 3/2003 | Lindquist |
| 6,533,276 | B2 | | 3/2003 | Soltys et al. |
| 6,533,662 | B2 | | 3/2003 | Soltys et al. |
| 6,568,678 | B2 | | 5/2003 | Breeding et al. |
| 6,579,180 | B2 | | 6/2003 | Soltys et al. |
| 6,579,181 | B2 | | 6/2003 | Soltys et al. |
| 6,582,301 | B2 | | 6/2003 | Hill |
| 6,582,302 | B2 | | 6/2003 | Romero |
| 6,585,586 | B1 | | 7/2003 | Romero |
| 6,585,856 | B2 | | 7/2003 | Zwick et al. |
| 6,588,750 | B1 | | 7/2003 | Grauzer et al. |
| 6,588,751 | B1 | * | 7/2003 | Grauzer et al. ..... 273/149 R |
| 6,595,857 | B2 | | 7/2003 | Soltys et al. |
| 6,616,535 | B1 | | 9/2003 | Nishizaki et al. |
| 6,622,185 | B1 | | 9/2003 | Johnson et al. |
| 6,629,889 | B2 | | 10/2003 | Mothwurf |

| | | | | |
|---|---|---|---|---|
| 6,629,894 | B1 | 10/2003 | Purton | |
| 6,637,622 | B1 | 10/2003 | Robinson | |
| 6,638,161 | B2 | 10/2003 | Soltys et al. | |
| 6,645,068 | B1 | 11/2003 | Kelly et al. | |
| 6,645,077 | B2 | 11/2003 | Rowe | |
| 6,651,981 | B2 * | 11/2003 | Grauzer et al. | 273/149 R |
| 6,651,982 | B2 | 11/2003 | Grauzer et al. | |
| 6,652,379 | B2 | 11/2003 | Soltys et al. | |
| 6,655,684 | B2 * | 12/2003 | Grauzer et al. | 273/149 R |
| 6,659,460 | B2 | 12/2003 | Blaha et al. | |
| 6,663,490 | B2 | 12/2003 | Soltys et al. | |
| 6,666,768 | B1 | 12/2003 | Akers | |
| 6,676,127 | B2 * | 1/2004 | Johnson et al. | 273/149 R |
| 6,676,517 | B2 | 1/2004 | Beavers | |
| 6,685,567 | B2 | 2/2004 | Cockerille et al. | |
| 6,685,568 | B2 | 2/2004 | Soltys et al. | |
| 6,688,979 | B2 | 2/2004 | Soltys et al. | |
| 6,698,756 | B1 | 3/2004 | Baker et al. | |
| 6,712,696 | B2 | 3/2004 | Soltys et al. | |
| 6,719,634 | B2 | 4/2004 | Mishina et al. | |
| 6,726,205 | B1 | 4/2004 | Purton | |
| 6,732,067 | B1 | 5/2004 | Powderly | |
| 6,746,333 | B1 | 6/2004 | Onda et al. | |
| 6,758,751 | B2 | 7/2004 | Soltys et al. | |
| 6,758,757 | B2 | 7/2004 | Luciano, Jr. et al. | |
| 6,804,763 | B1 | 10/2004 | Stockdale et al. | |
| 6,848,844 | B2 * | 2/2005 | McCue et al. | 400/188 |
| 6,886,829 | B2 | 5/2005 | Hessing et al. | |
| 6,889,979 | B2 | 5/2005 | Blaha et al. | |
| 6,959,925 | B1 | 11/2005 | Baker et al. | |
| 6,959,935 | B2 * | 11/2005 | Buhl et al. | 280/124.11 |
| 6,964,612 | B2 | 11/2005 | Soltys et al. | |
| 7,011,309 | B2 | 3/2006 | Soltys et al. | |
| 7,029,009 | B2 | 4/2006 | Grauzer et al. | |
| 7,036,818 | B2 | 5/2006 | Grauzer et al. | |
| 7,059,602 | B2 * | 6/2006 | Grauzer et al. | 273/149 R |
| 7,066,464 | B2 | 6/2006 | Blad et al. | |
| 7,073,791 | B2 * | 7/2006 | Grauzer et al. | 273/149 R |
| 7,124,947 | B2 | 10/2006 | Storch | |
| 7,139,108 | B2 * | 11/2006 | Andersen et al. | 358/474 |
| 7,213,812 | B2 | 5/2007 | Schubert et al. | |
| 7,237,969 | B2 * | 7/2007 | Bartman | 400/646 |
| 7,255,344 | B2 * | 8/2007 | Grauzer et al. | 273/149 R |
| 7,322,576 | B2 * | 1/2008 | Grauzer et al. | 273/149 R |
| 7,338,044 | B2 * | 3/2008 | Grauzer et al. | 273/149 R |
| 7,367,561 | B2 * | 5/2008 | Blaha et al. | 273/149 R |
| 7,384,044 | B2 | 6/2008 | Grauzer et al. | |
| 7,413,191 | B2 * | 8/2008 | Grauzer et al. | 273/149 R |
| 7,448,626 | B2 | 11/2008 | Fleckenstein | |
| 7,510,186 | B2 | 3/2009 | Fleckenstein | |
| 7,523,935 | B2 | 4/2009 | Grauzer et al. | |
| 7,661,676 | B2 * | 2/2010 | Smith et al. | 273/149 R |
| 7,753,798 | B2 | 7/2010 | Soltys et al. | |
| 7,766,332 | B2 * | 8/2010 | Grauzer et al. | 273/149 R |
| 7,867,080 | B2 | 1/2011 | Nicely et al. | |
| 8,070,574 | B2 * | 12/2011 | Grauzer et al. | 463/11 |
| 8,141,875 | B2 * | 3/2012 | Grauzer et al. | 273/149 R |
| 2001/0036231 | A1 | 11/2001 | Easwar et al. | |
| 2002/0107067 | A1 | 8/2002 | McGlone et al. | |
| 2002/0187830 | A1 | 12/2002 | Stockdale et al. | |
| 2003/0052450 | A1 | 3/2003 | Grauzer et al. | |
| 2003/0064798 | A1 | 4/2003 | Grauzer et al. | |
| 2003/0090059 | A1 | 5/2003 | Grauzer et al. | |
| 2003/0094756 | A1 | 5/2003 | Grauzer et al. | |
| 2003/0195025 | A1 | 10/2003 | Hill | |
| 2004/0067789 | A1 | 4/2004 | Grauzer et al. | |
| 2004/0224777 | A1 | 11/2004 | Smith et al. | |
| 2005/0035548 | A1 | 2/2005 | Yoseloff et al. | |
| 2005/0037843 | A1 | 2/2005 | Wells et al. | |
| 2005/0051956 | A1 | 3/2005 | Grauzer et al. | |
| 2005/0104289 | A1 | 5/2005 | Grauzer et al. | |
| 2005/0104290 | A1 | 5/2005 | Grauzer et al. | |
| 2005/0146093 | A1 | 7/2005 | Grauzer et al. | |
| 2005/0206077 | A1 | 9/2005 | Grauzer et al. | |
| 2005/0242500 | A1 | 11/2005 | Downs, III | |
| 2006/0033269 | A1 | 2/2006 | Grauzer et al. | |
| 2006/0046853 | A1 | 3/2006 | Black | |
| 2006/0181022 | A1 | 8/2006 | Grauzer et al. | |
| 2006/0279040 | A1 | 12/2006 | Downs, III et al. | |
| 2007/0006708 | A1 | 1/2007 | Laakso | |
| 2007/0102879 | A1 | 5/2007 | Stasson | |
| 2007/0278739 | A1 | 12/2007 | Swanson | |
| 2008/0113700 | A1 | 5/2008 | Czyzewski et al. | |
| 2008/0303210 | A1 | 12/2008 | Grauzer et al. | |
| 2010/0276880 | A1 | 11/2010 | Grauzer et al. | |
| 2011/0109042 | A1 | 5/2011 | Rynda et al. | |

FOREIGN PATENT DOCUMENTS

| | | |
|---|---|---|
| WO | WO 98/40136 | 9/1998 |
| WO | WO 00/51076 | 8/2000 |

OTHER PUBLICATIONS http://www.google.com/search?tbm=pts &q=shuffling+zone+on+opposite+side+of+input+... Jul. 18, 2012.* http://www.google.com/search?tbm=pts &q=Card+handling+device+with+input+and+outpu... Jun. 8, 2012.*

Service Manual/User Manual for Single Deck Shufflers: BG1, BG2 and BG3 by Shuffle Master © 1997.

CD Labeled "Shuffler Art". Attached to this 1449 is a spreadsheet having the names of the individual files within the CD. There is a self-executing function on the CD so that, upon entering the Spreadsheet Table of Contents (Index), individual items may be opened directly from the spreadsheet according to the title of the document.

DVD Labeled "Luciano Decl. Ex. K". This is the video taped live Declaration of Mr. Luciano (see list of patents on the 1449 or of record in the file history) taken during preparation of litigation.

DVD Labeled "Solberg Decl. Ex. C". This is the video taped live Declaration of Mr. Solberg, a witness for the defense, taken during preparation for litigation.

DVD labeled Morrill Decl. Ex. A:. This is the video taped live Declaration of Mr. Robert Morrill, a lead trial counsel for the defense, taken during preparation for litigation. He is describing the operation of the Roblejo Prototype device. See Roblejo patent in 1449 or of record.

DVD labeled Exhibit 1. This is a DVD taken by Shuffle Master personnel of the live operation of a CARD One2Six™ Shuffler.

Scarne's Encyclopedia of Games by John Scarne, 1973, "Super Contract Bridge", p. 153.

Specification of Australian Patent Application No. 31577/95, filed Jan. 17, 1995, Applicants: Rodney G. Johnson et al., Title: Card Handling Apparatus.

Specification of Australian Patent Application No. Not Listed, filed Aug. 15, 1994, Applicants: Rodney G. Johnson et al., Title: Card Handling Apparatus.

PCT International Search Report and Written Opinion of the International Searching Authority for PCT/US2008/007069, dated Sep. 8, 2008, 10 pages.

PCT International Search Report for PCT/US07/15036, dated Sep. 23, 2008, 3 pages.

PCT International Search Report for PCT/US07/15035, dated Sep. 29, 2008, 3 pages.

PCT Written Opinion for PCT/US07/15036, dated Sep. 23, 2008, 3 pages.

PCT Written Opinion for PCT/US07/15035, dated Sep. 29, 2008, 3 pages.

Press Release for Alliance Gaming Corp., Jul. 26, 2004—Alliance Gaming Announces Contract With Galaxy Macau for New MindPlay Baccarat Table Technology, http://biz.yahoo.com/prnews.

Tracking the Tables, by Jack Bulavsky, Casino Journal, May 2004, vol. 17, No. 5, pp. 44-47.

* cited by examiner

CARD SHUFFLER WITH ADJACENT CARD INFEED AND CARD OUTPUT COMPARTMENTS

CROSS-REFERENCE TO RELATED APPLICATIONS

This application is related to U.S. patent application Ser. No. 12/848,631, filed Aug. 2, 2010, now U.S. Pat. No. 8,141,875, issued Mar. 27, 2012, which is a divisional of U.S. patent application Ser. No. 11/598,259, filed Nov. 9, 2006, now U.S. Pat. No. 7,766,332, issued Aug. 3, 2010, for CARD HANDLING DEVICES AND METHODS OF USING THE SAME, and related to U.S. patent application Ser. No. 11/810,864, filed Jun. 6, 2007, now U.S. Pat. No. 8,070,574, issued Dec. 6, 2011, for APPARATUS, SYSTEM, METHOD, AND COMPUTER-READABLE MEDIUM FOR CASINO CARD HANDLING WITH MULTIPLE HAND RECALL CREATURE.

BACKGROUND OF THE INVENTION

1. Field of the Invention

The present invention relates to devices for handling cards, including cards known as "playing cards." In particular, the invention relates to an electromechanical machine for organizing or arranging playing cards into a plurality of randomly arranged groups of cards. All references cited in this entire document are herein incorporated by reference in their entirety.

2. Background of the Art

Wagering games based on the outcome of randomly generated arrangements of cards are well known. Such games are widely played in gaming establishments and often a single deck of 52 playing cards is used to play the game. Some games use multiple decks of cards (typically six or eight decks), such as blackjack and baccarat. Other games use two decks of cards, such as double deck blackjack. Many specialty games use single decks of cards, with or without jokers and with or without selected cards removed. Examples of such games include THREE CARD POKER®, LET IT RIDE®, CARIBBEAN STUD POKER™, SPANISH 21®, FOUR CARD POKER®, CRAZY 4 POKER® and others. As new games are developed, card shufflers are modified to be used in connection with the new games.

From the perspective of players, the time the dealer must spend in shuffling diminishes the excitement of the game. From the perspective of casinos, shuffling time reduces the number of hands placed, reduces the number of wagers placed and resolved in a given amount of time, thereby reducing revenue. Casinos would like to increase the amount of revenue generated by a game without changing the game. One approach is to simply speed up play. One option is to decrease the time the dealer spends shuffling.

This approach has lead to the development of electromechanical or mechanical card shuffling devices. Such devices increase the speed of shuffling and dealing, thereby increasing playing time. Such devices also add to the excitement of a game by reducing the amount of time the dealer or house has to spend in preparing to play the game.

Dealers appreciate using card shufflers that place the minimum strain on the dealer's hands, back and arms. Some existing shuffler designs put unnecessary strain on the muscles of the users. Dealers prefer shufflers that are low profile, especially when the shuffler dispenses cards into a game rather than shufflers that shuffle batches of cards for shoe games.

Numerous approaches have been taken to the design of card shufflers. Among them include random ejection designs (Sines et al., U.S. Pat. Nos. 6,299,167; 6,019,368; 5,676,372; and 5,584,483; Baker et al., U.S. Pat. Nos. 6,959,925 and 6,698,756, for example), stack separation and insertion (Johnson et al. U.S. Pat. Nos. 5,683,085 and 5,944,310), interleaving designs (Breeding U.S. Pat. Nos. 5,275,411 and 5,695,189), for example, random insertion using a blade (Blaha, U.S. Pat. No. 5,382,024) and designs that utilize multiple shuffling compartments.

One such example of a compartment shuffler is disclosed in Lorber et al., U.S. Pat. No. 4,586,712. The automatic shuffling apparatus disclosed is designed to intermix multiple decks of cards under the programmed control of a computer. The Lorber et al. apparatus is a carousel-type shuffler having a container, a storage device for storing shuffled playing cards, a removing device and an inserting device for intermixing the playing cards in the container, a dealing shoe and supplying means for supplying the shuffled playing cards from the storage device to the dealing shoe. The container includes multiple card-receiving compartments, each one capable of receiving a single card.

Another shuffler having mixing compartments arranged in a carousel is disclosed in Johnson et al. U.S. Pat. No. 6,267,248. Cards are loaded into an infeed tray, fed sequentially past a card reading sensor and are inserted into compartments within a carousel to either randomize or sort cards into a preselected order. The carousel moves in two directions during shuffling. Johnson et al. U.S. Pat. No. 6,676,127 describes another variation of the shuffler, in which cards are inserted into and removed from a same side of the carousel, with the card infeed tray being located above the discard tray (see FIG. 3).

U.S. Pat. No. 3,897,954 (Erickson et al.) discloses a device for delivering cards, one at a time, into one of a number of vertically stacked card-shuffling compartments. The Erickson patent also discloses using a logic circuit to determine the sequence for determining the delivery location of a card, and that a card shuffler can be used to deal stacks of shuffled cards to a player.

U.S. Pat. No. 4,770,421 (Hoffman) discloses a card-shuffling device including a card loading station with a conveyor belt. The belt moves the lowermost card in a stack onto a distribution elevator whereby a stack of cards is accumulated on the distribution elevator. Adjacent to the elevator is a vertical stack of mixing pockets. A microprocessor preprogrammed with a finite number of distribution schedules sends a sequence of signals to the elevator corresponding to heights called out in the schedule. Each distribution schedule comprises a preselected distribution sequence that is fixed as opposed to random. Single cards are moved into the respective pocket at that height. The distribution schedule is either randomly selected or schedules are executed in sequence. When the microprocessor completes the execution of a single distribution cycle, the cards are removed a stack at a time and loaded into a second elevator. The second elevator delivers cards to an output reservoir.

Breeding U.S. Pat. No. 5,275,411 discloses a machine for automatically shuffling and dealing hands of cards. Although this device does not shuffle cards by distributing cards to multiple compartments, the machine is the first of its kind to deliver randomly arranged hands of cards to a casino card game. A single deck of cards is shuffled and then cards are automatically dispensed into a hand-forming tray. The shuffler includes a deck-receiving zone, a carriage section for separating a deck into two deck portions, a sloped mechanism positioned between adjacent corners of the deck portions, and an apparatus for snapping the cards over the sloped mechanism to interleave the cards. The Breeding shuffler was originally designed to be used in connection with single deck poker style games such as LET IT RIDE® Stud Poker and a variant of Pai Gow Poker marketed as WHO'S FIRST™ Pai Gow Poker.

In an attempt to speed the rate of play of specialty table games equipped with a shuffler, the ACE® card shuffler as disclosed in U.S. Pat. Nos. 6,149,154, 6,588,750, 6,655,684 and 7,059,602 was developed. This shuffler operates at faster speeds than the Breeding shuffler described above, has fewer moving parts and requires much shorter set up time than the prior Breeding design. The shuffler includes a card infeed tray, a vertical stack of shuffling compartments and a card output tray. A first card moving mechanism advances cards individually from the infeed tray into a compartment. A processor randomly directs the placement of fed cards into the compartments, and an alignment of each compartment with the first card mover, forming random groups of cards within each compartment. Groups of cards are unloaded by a second card moving mechanism into the output tray.

Another compartment shuffler capable of delivering randomly arranged hands of cards to a casino card game is the ONE2SIX® shuffler (developed by Casino Austria Research & Development (CARD)). This shuffler is disclosed in U.S. Pat. Nos. 6,659,460 and 6,889,979. This shuffler is capable of delivering randomly arranged hands of cards when a first delivery end is attached, and is capable of delivering a continuous supply of cards from a shoe-type structure when a second delivery end is attached. Cards are fed from a feeder individually into compartments within a carousel to accomplish random ordering of cards.

Most of the known shuffler designs are high profile and require loading cards into the rear of the machine, and then removing cards from the front of the machine. The cards must be lifted over the top of the machine to return spent cards to the infeed tray, causing a dealer to lift his arm over the top of the machine at the conclusion of each round of play.

The present ACE® shuffler as well as its predecessor BG-3 are batch type shufflers. One characteristic of a (single or double deck) batch shuffler is that when all of the cards are dispensed in a round of play, the remaining cards in the pack (one or two decks) are removed and then reinserted. In use, while the game is being dealt with a first deck, a second deck of cards is being randomized and arranged into groups. A discard rack is typically provided on the table so that cards removed from the game are staged in the rack while the other deck of cards is being processed. Following this procedure avoids the possibility that cards will be returned to the input tray and that the two decks will be intermingled. The use of two separate decks (one at a time) speeds game play because shuffling occurs during play. It would be desirable to eliminate the use of a discard tray so that cards from the two decks cannot be accidentally intermixed when a dealer fails to use the discard rack.

Sines U.S. Pat. No. 6,959,925 discloses a single deck continuous card shuffler known in the trade as the Poker One. This shuffler avoids the alternating use of two different decks of cards during a specialty card game by providing a continuous supply of cards to a card game. Although this shuffler uses only one deck of cards, the shuffler does not verify that the correct number of cards (typically 52) are present prior to each shuffle, and consequently cheating by inserting extra cards would go undetected.

Shufflers that communicate with network-based game systems have been described in the art. An example is described in U.S. Patent Publication 2003/0064798 A1. A shuffler with an on-board microprocessor and communication port communicates with a local processor and/or a central processor. The local or central processor may manage a game system.

It would be advantageous to provide a shuffler that has all of the performance attributes of known shufflers, has state of the art security features, that eliminates the need for a discard rack and provides an ergonometric design for end users.

SUMMARY OF THE INVENTION

A playing card handling device is disclosed. The device has a first side, a second opposite side, a card infeed tray, a card output tray and a card handling zone. The card infeed tray and card output tray are on the same first side of the device. An upper edge of the card infeed tray and an upper edge of the card output tray are located in the same plane. One preferred card handling zone is a card shuffling zone. An example of a card shuffling zone is a carousel with compartments for receiving playing cards. Alternatively, the card shuffling zone comprises a vertical rack with compartments for receiving playing cards. Other examples of suitable card shuffling zones include a fan with compartments or a random ejection system.

In an example of the invention, the card infeed tray comprises a movable gate, the gate capable of providing a physical separation of cards being fed and cards being returned to the playing card input compartment after play. The movable gate also applies a downward force on cards being fed.

One preferred configuration of the device includes the upper surfaces of the card input tray and card output tray surface mounted on a gaming table surface. A preferred transportation path of cards moving towards the card handling zone is located beneath the output tray. In other forms of the invention, the transportation path passes above the output tray, and cards within the output tray are elevated to the gaming surface. In one embodiment of the invention, the transportation path is substantially linear.

A feature of an example of the invention is a graphical display with touch screen controls. The touch screen controls may be used to operate the machine as well as program the machine to display new game names and to dispense cards for new games.

Examples of commands that can be inputted through the touch screen include: a number of table positions, a number of cards per hand, a number of dealer cards, a number of common cards, a number of bonus cards and a game name.

A playing card shuffling device for use in a casino or card room is disclosed. The device comprises a playing card shuffler having a processor, a video or graphic display with integral touch screen controls. The video or graphic display is capable of automatically displaying information from the shuffler and the touch screen controls are capable of sending user inputted data to the processor to affect performance or activity of the shuffler. The touch screen controls are used to program the shuffler. The following types of information may be entered: a number of table positions, a number of cards per hand, a number of dealer cards, a number of common cards, a number of bonus cards and a game name.

The display of the present invention is capable of displaying alphanumeric information, graphical information, animation, video feed and the like. Examples of typically displayed information include: product name, a casino name, a table identification, a game name, a number of shuffles, a number of hands dealt, an error message, a warning message, an indication of use, a card jam, a need for service, and programming prompts. The display may be located on the end of the device closest to the dealer, and may be mounted below the gaming surface so that displayed information is available only to the dealer.

A casino table card gaming system comprises a playing card handling device. The playing card handling device is capable of forming groups of cards for delivery to a live card game, reading rank and suit; and transmitting data representing at least card group composition to a database via a network connection. Groups of delivered cards may be a player hand, a dealer hand, a partial player hand, a partial dealer hand, a bonus hand, and a group of community cards. The device may also be capable of transmitting to the database data relating to events occurring in the shuffler, such as start of card feeding, start deal, start shuffle, end shuffle, end dealing, shuffling complete, compartment full, compartment empty, shuffler unloaded, dealer activated signal, and shuffler loaded.

Data from the card handling device may be transmitted directly to an external computer or to a network computer via hard wire or wireless transmission. Examples of data transmitted include an internal shuffler command relating to starting or completing dealing of a round of play in a card game.

A card infeed module for a card shuffler is disclosed. The module includes a card infeed tray having a lower surface and at least two substantially upright walls for supporting cards and a card gate pivotally mounted above the lower surface. The gate is capable of applying a downward force in a lower position and is also capable of separating a first group of cards from a second group of cards, both groups located in the infeed tray. The infeed module includes a feed roller having a contact surface that extends through the lower surface to move a lowermost card out of the card infeed tray. A card gate is also provided in the card infeed module. The card gate is pivotally mounted about a horizontal axis. After card feeding is complete, the card gate automatically pivots upwardly to lower separated cards onto the lower surface of the infeed tray.

A bonusing system for live card games is disclosed. The system includes multiple card shufflers, each capable of dispensing bonus cards in response to a signal from a central computer. The system is controlled by a central computer. The central computer controls the dispensation of bonus cards. Each shuffler is capable of receiving a command from the central computer to dispense a bonus card. The system can be used for multiple like card games or multiple different card games.

A card shuffler is disclosed including a card infeed area, a card output area; a card shuffling mechanism and a processor. The processor is programmed to perform a diagnostic routine in response to the insertion of at least one card. In one example of the invention, the diagnostic routine is performed in response to the insertion of a single card.

DETAILED DESCRIPTION OF THE INVENTION

The present invention is a card handling system designed for providing randomized groups of cards to card games. Many components of the system are conventional commercially available components unless otherwise indicated, including motors, belts, pulleys, rotational shafts, rollers, sprockets, gears, pinions, pulleys, cams, support structures and the like. The electrical components may include conventional circuitry, wires, fuses, soldered connections, chips, switches, boards, microprocessors, stepper motors, computers, and control system components.

Generally, unless specifically otherwise disclosed or taught, the materials for making the various components of the present invention are selected from appropriate materials such as plastics, metal, metallic alloys, ceramics, fiberglass, elastomers, composites and the like.

A shuffler of the present invention includes major components that are physically arranged (for example, in a linear arrangement) in the following order: a) a playing card input compartment; b) a playing card retrieval compartment; and c) a playing card handling zone. Playing cards from the playing card input compartment are moved into the playing card handling zone, are handled and are then moved from the playing card handling zone into the playing card retrieval compartment.

Figure 1:
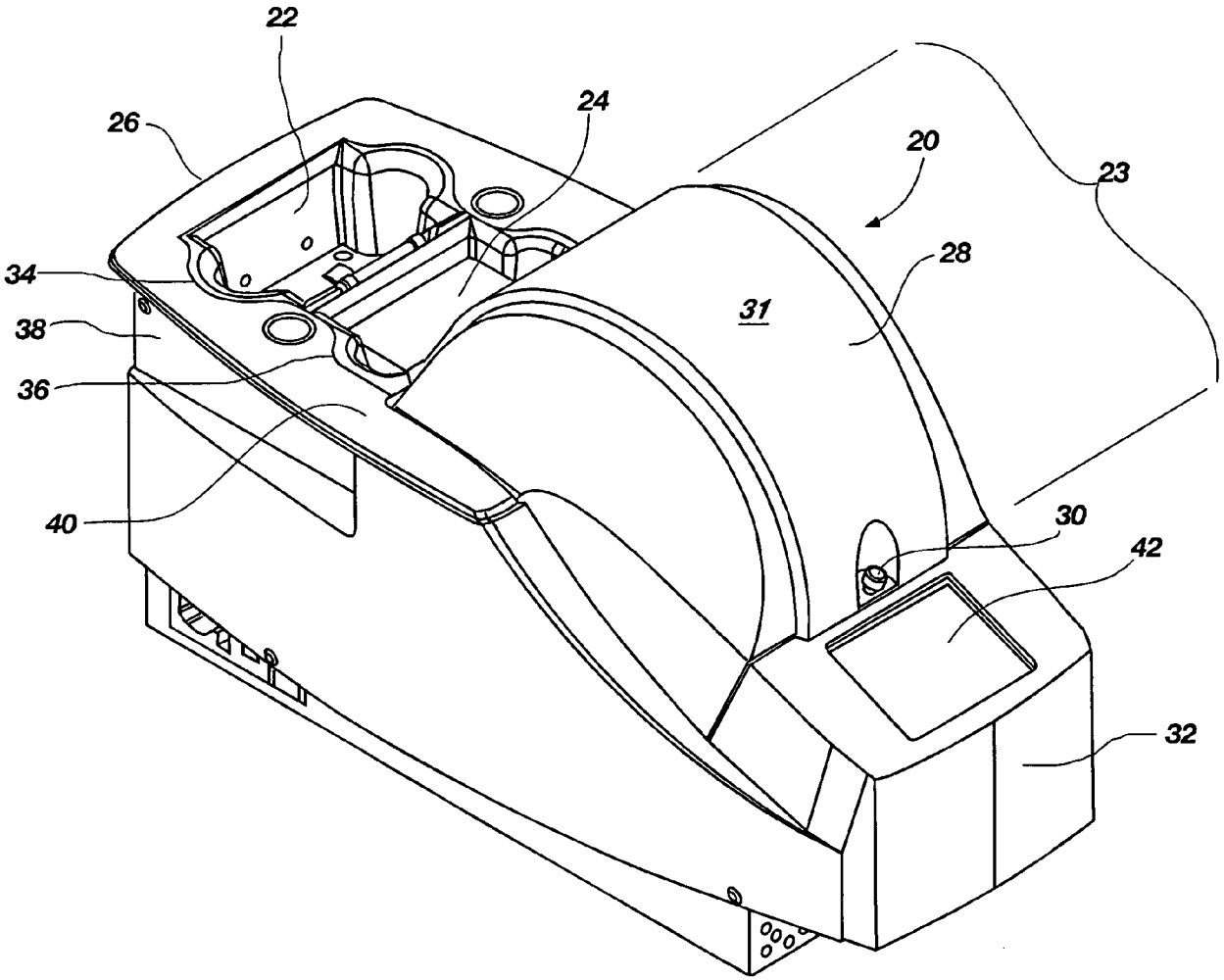
FIG. 1 is a perspective view of a first embodiment of a shuffler of the present invention.

A perspective view of a first exemplary playing card shuffler 20 of the present invention is shown in FIG. 1. The card shuffler 20 has a recessed card infeed tray 22 and an adjacent recessed card output tray 24 located near a first end 26 of the card shuffler 20, and a plurality of card shuffling compartments (shown in FIG. 2) arranged into a carousel structure 44 (shown in FIG. 2) positioned within card handling zone 23. A cover 28 in this embodiment has a curved upper surface 31 that is arched to enclose an upper portion of the carousel structure 44. The cover 28 includes a lock 30 to secure the cover 28 to the frame (not shown) to prevent the unauthorized access to cards in the carousel. This locking feature advantageously allows a casino operator to shut down a table with all of the cards loaded into the card shuffler 20. When the table is reopened, the operator can be assured that the cards held in the playing card shuffler 20 are secure. The key to the lock is held by pit management and the fact that the cover 28 is locked advantageously eliminates the need to unload and verify the rank and suit of each card before play is resumed. Securing the cards within the playing card shuffler 20 when the playing card shuffler 20 is not in use is a valuable time and labor saving feature. The lock 30 is located proximate a second end 32 of the playing card shuffler 20. Although an exemplary lock is a simple mechanical lock with rollers and a key, other locking systems may be used, such as electronic locks with keypad controls, locking systems that receive RFID signatures, computer-controlled locks and other known locking systems.

The shuffler 20 is mounted for use such that a portion of the shuffler 20, including the first end 26 is flush mounted on a gaming table. A second portion of the shuffler 20 may be supported near the second end 32 by means of a mounting bracket (not shown) secured to the table structure. Installation of the shuffler 20 into the table typically requires a cut-out in the table surface intersecting a rear edge of the table (the edge nearest the dealer). More details on mounting the shuffler 20 to the gaming table (not shown) are provided below.

For purposes of this disclosure, the "first end 26" refers to the end of the machine nearest the players when the shuffler 20 is installed in a table top, and the "second end 32" refers to the end facing the pit.

The relative arrangement of the card infeed tray 22, the card output tray 24 and the card handling zone 23 has certain advantages. Because the card infeed tray 22 and the card output tray 24 are located on the same side of the card handling zone 23, the cards are more accessible to the dealer, and the dealer no longer has to lift cards over the shuffling zone to place spent cards back into the playing card shuffler 20. The present design is therefore more ergonometric than known designs. Positioning the card infeed tray 22 at the table level also reduces the possibility that card faces will be accidentally flashed to players.

The placement of an upper edge 34 of the card infeed tray 22 and an upper edge 36 of the output tray 24 in the same plane (the plane lying on the gaming surface) also provides distinct ergonometric advantages. If the dealer moves his or her hands smaller distances during card handling, he or she is likely to experience fewer repetitive stress or strain injuries. So delivering spent cards to the shuffler at the gaming surface and then retrieving freshly randomized cards from the same location or nearby offers distinct user advantages.

The placement of the infeed tray 22 and the output tray 24 on the same side of a carousel-type playing card handling zone (in this case a carousel type compartment structure) also allows the user to place spent cards face-down in the infeed tray 22, and at the same time receive fresh cards to the output tray 24 face-down. This attribute has been previously described in Johnson U.S. Pat. No. 6,676,127. This feature improves the security of a carousel shuffler, since no cards are exposed during loading, shuffling or unloading.

A horizontally disposed center line intersecting the card infeed tray 22 and the card output tray 24 also advantageously intersect a center line of the card handling zone 23, as will be discussed in more detail below. This arrangement allows the machine to be fairly narrow in width and permits both card tray areas (but not the more bulky card handling zone 23) to be located on the playing table surface.

Only a portion of the shuffler defined by the card infeed tray 22 and output tray 24 is located on the gaming table surface in one preferred mounting arrangement. A gaming table surface may have a rectangular notch cut into an edge of the flat table facing the dealer. The shuffler 20 has a recess 38 that receives the notch in the table. The remainder of the shuffler 20 is supported by a support bracket beneath the table surface. The card shuffling zone is located behind the dealer, and is out of the way.

As shown in FIG. 1, the portion of the playing card shuffler 20 that is inserted into the table may be flush mounted. The card infeed tray 22 and card output tray 24 may be surrounded by a substantially flat flange 40 intersecting the upper edges 34 and 36 of the card infeed tray 22 and the card output tray 24. In one example of the invention, the card output tray 24 is removable for maintenance. The shuffler 20 may be supported by the flange 40, or by a separate support structure attached to the table (not shown), known in the art as a table extension or both.

Near a second end 32 of the shuffler is a dealer display 42. In a preferred form of the invention, the dealer display includes touch screen controls. The operation of the display is described in more detail below.

Figure 1A:
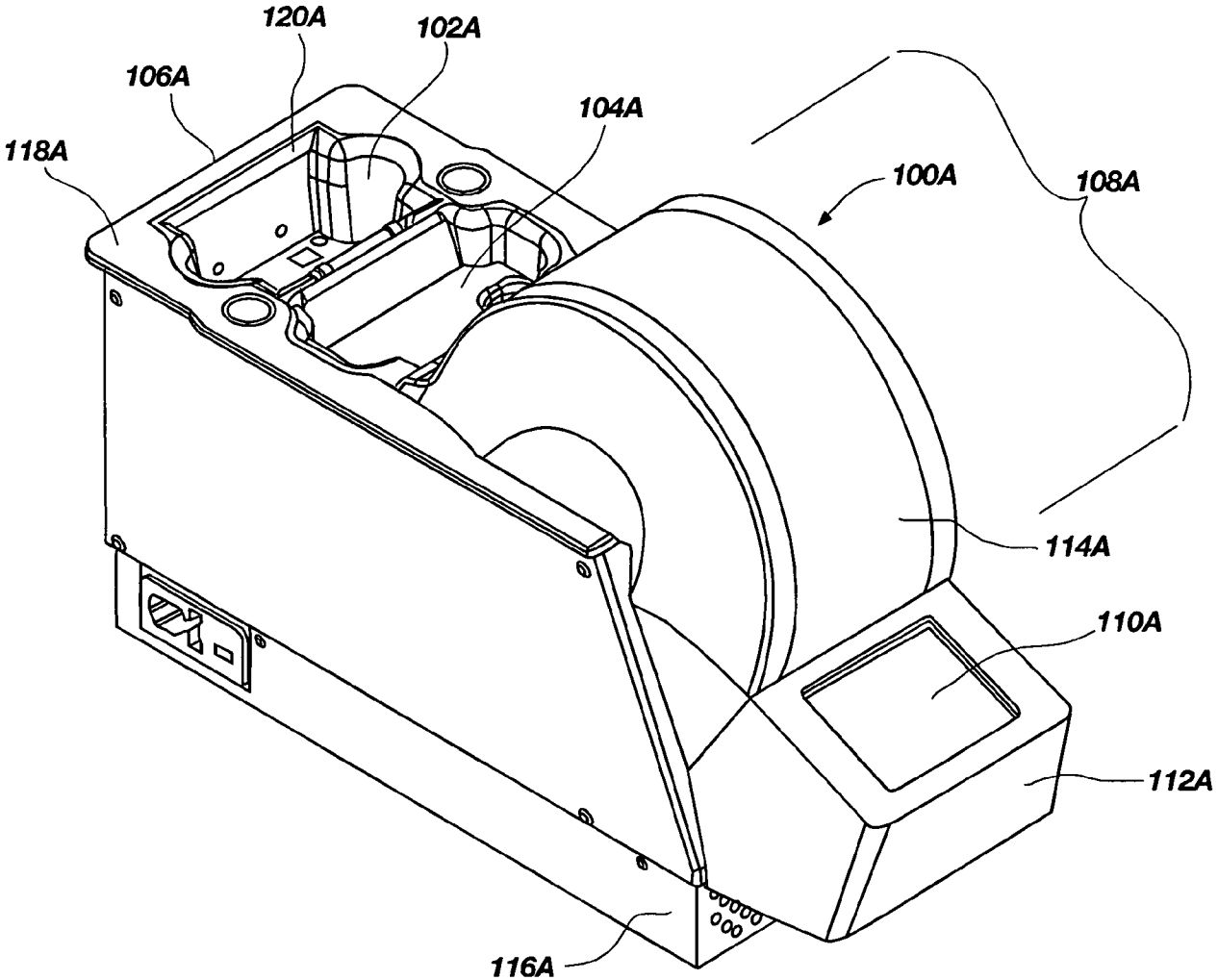
FIG. 1A is a perspective view of a second embodiment of a shuffler of the present invention.

A second embodiment of a shuffler of the present invention is shown in perspective view in FIG. 1A. The shuffler 100A has a card infeed compartment 102A, a card delivery compartment 104A near a first end 106A, a card handling zone 108A and a display 110A near a second end 112A. In this embodiment, a carousel (not shown) is enclosed within a cover 114A. The cover 114A is secured to the frame 116A and is removable for maintenance but is not intended to be removed by a user. In one example of the invention, the cover 114A is secured to the frame 116A with sheet metal screws. In this embodiment, a flange 118A intersects an upper edge 120A of the card infeed compartment 102A and the card delivery compartment 104A; and extends a portion of the way through the card handling zone 108A. This flange 118A may be mounted on the gaming table surface such that a portion of the card handling zone 108A is positioned within the outside perimeter of the gaming table. The display 110A is at an elevation below the gaming surface, as in the first example. The shuffler 100A may be supported by the flange 118A, a table extension (not shown), by a pedestal, by combinations of the above, or by other known support techniques.

Card Handling Zone

In one form of the invention, the card handling zone 23 is a playing card handling zone. This zone is capable of performing at least one of the following functions: a) shuffling, b) arranging cards into a desired order, c) verifying completeness of a group of cards, d) reading special markings on cards (such as casino i.d., manufacturer i.d., special bonus card i.d, deck i.d., etc.), e) scanning cards for unauthorized markings, 1) identifying cards lacking required markings, g) measuring card wear, h) decommissioning cards, i) applying markings to cards, j) scanning cards for unauthorized electronic devices, and many other useful functions.

One preferred shuffling zone format includes a multiple compartment carousel. Many other shuffling zones could be utilized, non-limiting examples including a random ejection shuffling zone as described in detail in U.S. Pat. No. 6,959,925 and assigned to VendingData, a vertical compartment shuffling zone as described in detail in U.S. Pat. No. 6,149,154, a plurality of compartments arranged in a fan shape or a vertical stack capable of being separated in randomly selected positions for insertion of cards as described in U.S. Pat. No. 6,651,981. The content of each patent referenced in this entire specification including background section is incorporated herein by reference.

Card Inspection Station

The card handling zone in one form of the invention includes a card inspection station that reads at least the conventional rank and suit markings on cards without changing an order of cards, while reversing an order of cards, or while shuffling. Non-limiting examples of suitable card readers include CMOS and CCD cameras. Other sensing systems such as CIS line scanning systems, such as the system disclosed in U.S. patent application Ser. No. 11/152,475, filed Jun. 13, 2005, now U.S. Pat. No. 7,769,232, issued Aug. 3, 2010, and in U.S. patent application Ser. No. 11/417,894, filed May 3, 2006, now U.S. Pat. No. 7,593,544, issued Sep. 22, 2009, may also be used. The content of this disclosure is herein incorporated by reference in its entirety. The card inspection station may alternately be equipped to read a) special markings on cards, such as bar codes, near IR markings, IR markings, b) embedded electronic devices, c) cards that have been marked in a way to facilitate cheating, d) card wear, e) physical card damage and the like. The cards may be standard unmarked conventional cards, or may be marked with UV, IR, near-IR or visible wavelength inks or may have embedded RFID tags, magnetic coding or may be marked by any other known means.

Display

Referring back to FIG. 1, the touch screen display 42 in this example of the invention is located below the gaming table surface. One preferred display may be obtained from Reach Technologies of Fremont, Calif., by specifying part number 42-0092-03. The location of the display 42 relative to the gaming table surface offers a number of distinct advantages not known in the art before the present invention. For example, the display may provide graphics such as the cards dealt into a player hand, allowing the dealer to assess whether the actual cards are different, without alerting the player. For example, if a deviation between an actual hand and a displayed hand were to occur, indicating a confirmed case of card switching, the dealer would want to notify security without the player's knowledge so that the cheater is apprehended. By providing a display that is concealed to the players, important information may be transferred to and from casino personnel without the knowledge of the players.

The display 42 includes touch screen user controls that can be used to program the microprocessor of the shuffler 20 to perform a number of operations. For example, the shuffler 20 is programmable to deliver a specified number of cards to a specified number of players. The shuffler 20 may further be programmed to deliver a specified amount of dealer cards, a specified amount of flop cards, a bonus hand, common cards or any other card or cards used in the play of a casino card game. The user controls may also be used to input and display a game name, so that the new name appears on a menu of user selectable games. Eliminating the need for factory programming each time a new casino card game is developed saves time, eliminates the need for resubmission of software to the various gaming agencies for approval and eliminates the need for upgrading software in the field.

For example, the device could be programmed by the operator to deliver cards to the game of THREE CARD POKER®, which requires that the players and dealer receive three cards each. If a new game that utilizes three player cards (each) and three dealer cards is developed in the future, the information, including the new game name can be input and added to a menu of games without requiring a software change.

The touch screen controls on the display 42 also provide a larger number of input options for the user, as compared to more standard push button controls. The display 42 is capable of displaying alphanumeric information, graphical information, animation, video feed and the like. In one form of the invention, a diagram of the card path and an indication of a location of a card jam is displayed when a card jam takes place.

Devices of the present invention may provide additional and useful functions. One such purpose is to deliver data, such as card composition, hand composition, rounds played, hands played, shuffler activated, shuffler deactivated, cards dealt, cards delivered to the carousel, and other game state and/or shuffler state information to a local processor and/or a network computer for analysis and reporting purposes. Since the carousel structure of the first described embodiment is capable of forming hands or partial hands of cards within the shuffler, the shuffler is capable of sending data to an external processor representing hand or partial composition.

A shuffler of the present invention may be incorporated into a table game management system by connecting the shuffler via a data port to a table game computer, a local table network or a casino network. The networks may be wired or wireless.

Card Feed System

Figure 2:
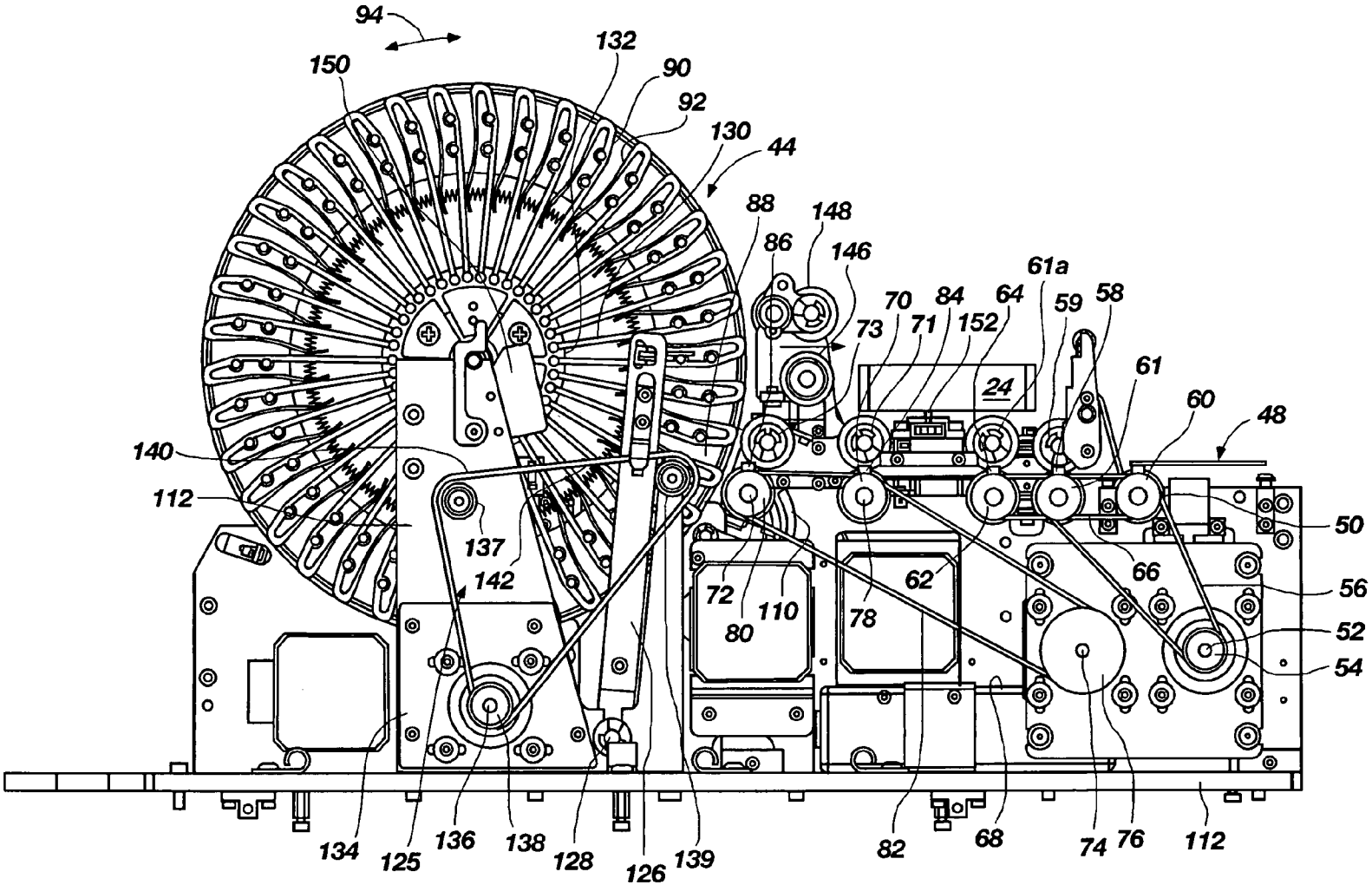
FIG. 2 is a first side elevational view of the shuffler, with components removed.

Referring now to FIG. 2, a side elevational view of a preferred embodiment of the shuffler is illustrated. A multiple compartment carousel structure 44 is provided to receive cards from the card infeed tray 22 (shown in FIG. 1). A lowermost card 48 in the stack of spent cards comes into contact with card feed roller 50. Card feed roller 50 is rotationally driven by a motor (not shown) having a drive shaft 52. Mounted to drive shaft 52 is drive sprocket 54 carrying endless toothed belt 56. Also driven by the same motor is first advancing roller 58. A sprocket 60 on the shaft supporting card feed roller 50 is provided for rotating second advancing roller 61. Endless belt 66 meshes with sprocket 60 as well as sprocket 68 so that all three rollers 50, 58 and 61 are driven by the same motor. Opposing roller 59 adjacent idler roller 58 forms a first nip 62, and adjacent idler roller 61*a* forms a second nip 64. The card 48 is moved horizontally by roller 50 into the first nip 62 and then is moved into the second nip 64. A second drive sprocket 68 is provided generally to third and fourth advancing rollers 70, 72. The drive system includes a motor (not shown), a drive shaft 74, a first pulley 76, a second pulley 78, a third pulley 80 and an endless member 82. The system functions to drive rollers 70 and 72 in the same direction. Opposing rollers 71 and 73 are provided to form third and fourth nips 84 and 86. The upper roller 73 of the fourth nip 86 serves the purpose of deflecting each card upwardly and into an aligned compartment.

In operation, cards move from the infeed tray 22, past each of the four roller pairs and into an aligned compartment 88. The carousel then rotates to align the card feed system with the next randomly selected compartment.

In another embodiment, pulley 78 is in contact and driven by sprocket 54 by means of a toothed belt (not shown), rather than endless member 82. This arrangement provides another method of driving the card advancing rollers in order to consistently move cards individually into the carousel structure 44.

Carousel

The carousel structure 44 in a preferred form of the invention has thirty-eight equally sized compartments, each capable of holding up to ten conventional cards. Other carousel structures with fewer or more compartments may be used. Each compartment has at least one beveled surface 90 for deflecting cards into the aligned compartment 88 during insertion. Another feature of the carousel structure 44 is that each compartment 88 is equipped with a leaf spring 92 that holds cards tightly within the compartment 88 after insertion so that when the carousel structure 44 rotates (as shown by arrow 94) in either direction during loading, shuffling or unloading, cards remain securely within the selected compartment.

According to a preferred mode of operation, half of the compartments are used for random card insertion, while at the same time the other half of the compartments are used for random group delivery. Although in one example of the invention, all of the compartments used for loading are adjacent to one another, in other forms of the invention, the selection of compartments utilized at a given time for loading is according to a pattern, or is randomly dispersed. In one example of the invention, a number of compartments are preassigned to collect discards, and others are designated to receive bonus cards. Bonus cards may be manually inserted by first removing the cover 28 (shown in FIG. 1), may be inserted through a secure opening in the cover (not shown) or may be inserted through the same card infeed tray 22 used to insert the regular playing cards. Bonus cards may be fed before or after the playing cards, or may be intermixed with the playing cards, detected and diverted to the designated compartment.

In a preferred example, the location of discard trays is dispersed amongst the group-forming trays so that the travel of the carousel structure 44 is minimized during random distribution. The assigned location of the discard trays may be different for different card games. In the first example of the invention, all of the compartments 88 are of equal size, making it possible to assign different compartments to the discard collection function for different numbers of cards per hand being assembled.

A novel feature of this embodiment is that the card path is substantially straight and substantially horizontal. The cards move the least distance following a straight path from the card infeed area to the aligned compartment 88. When the cards reach the last set of advancing rollers, the card is deflected slightly upwardly and into the compartment. The length of the path is kept to a minimum to minimize the length of the device, and to maximize the speed of delivery. Another novel feature of this embodiment is that the infeed card path is positioned beneath output card path and output tray 24 (FIG. 1), as will be described in more detail below. Layering the output card path and/or output tray 24 above the infeed path advantageously allows both the infeed tray 22 (FIG. 1) and the output tray 24 to be positioned on the same side of the machine. This physical arrangement of card paths has not been implemented before in the art to the knowledge of the present inventors. Alternatively, the device could be configured such that the card output path passes beneath the card input path.

Figure 3:
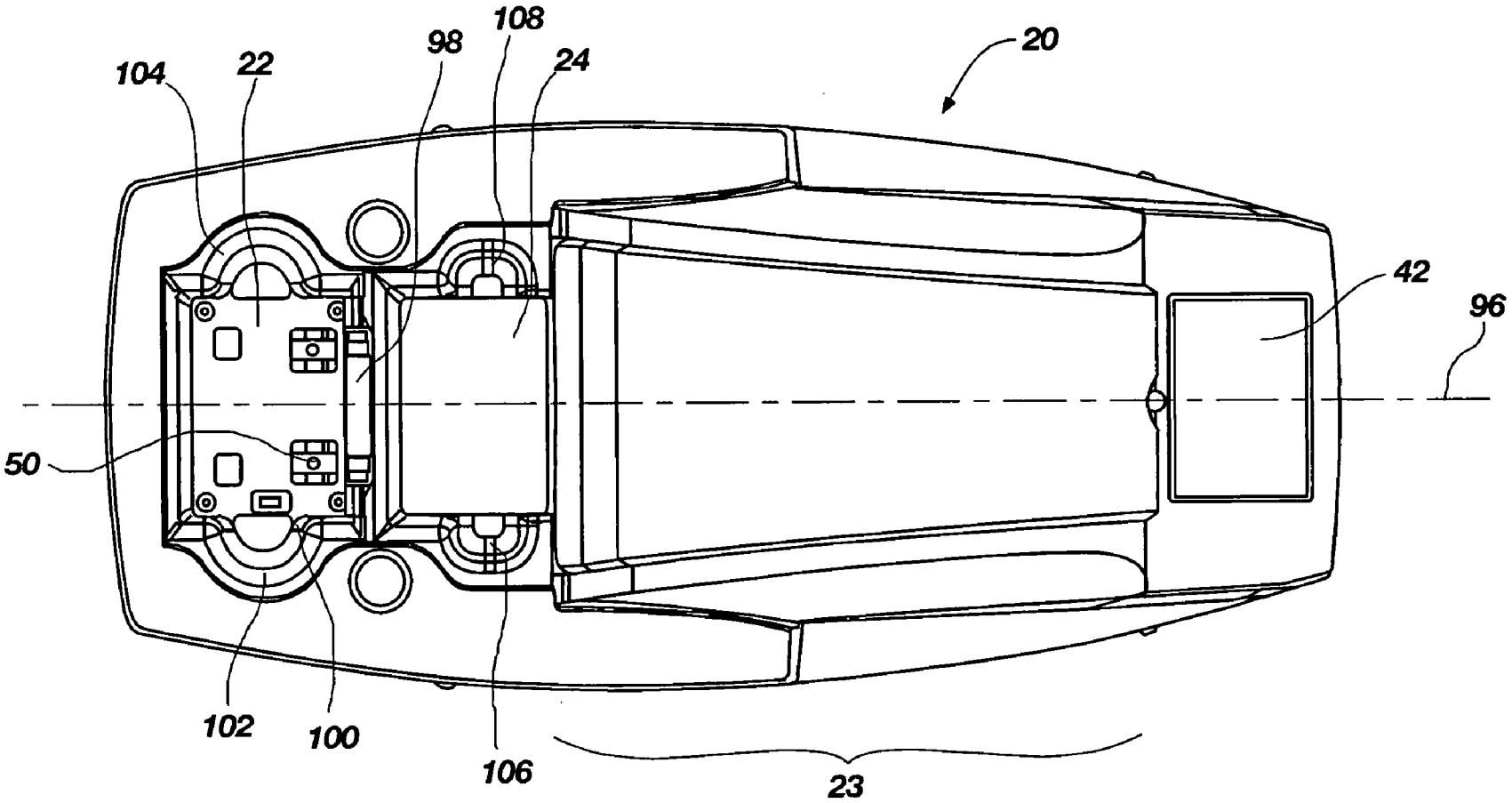
FIG. 3 is a top plan view of the shuffler.

Referring now to FIG. 3, a top plan view of the exemplary card shuffler 20 is shown. The card infeed tray 22 is positioned centrally along axis 96, as is adjacent card output tray 24, the card handling zone 23 and the touch screen display 42. The card infeed tray 22 is equipped with a dual function gate 98 whose functions will be described in more detail below. The card infeed tray 22 also includes a card present sensor 100, located on a lower surface.

Declining finger cut-outs 102, 104, 106, 108 are provided in the interior surfaces of the card infeed tray 22 and the card output tray 24 to facilitate handling of cards. Preferably the cut-outs 102, 104, 106, 108 are of a size and shape to accommodate a user's fingers, providing an additional ergonomic feature.

Another advantage of providing a carousel as part of the playing card handling zone is that the machine has a low profile on the table. Approximately half of the carousel may be located beneath the table surface of a gaming table when playing card shuffler 20 is installed in a table top.

Packer Arm

Figure 4:
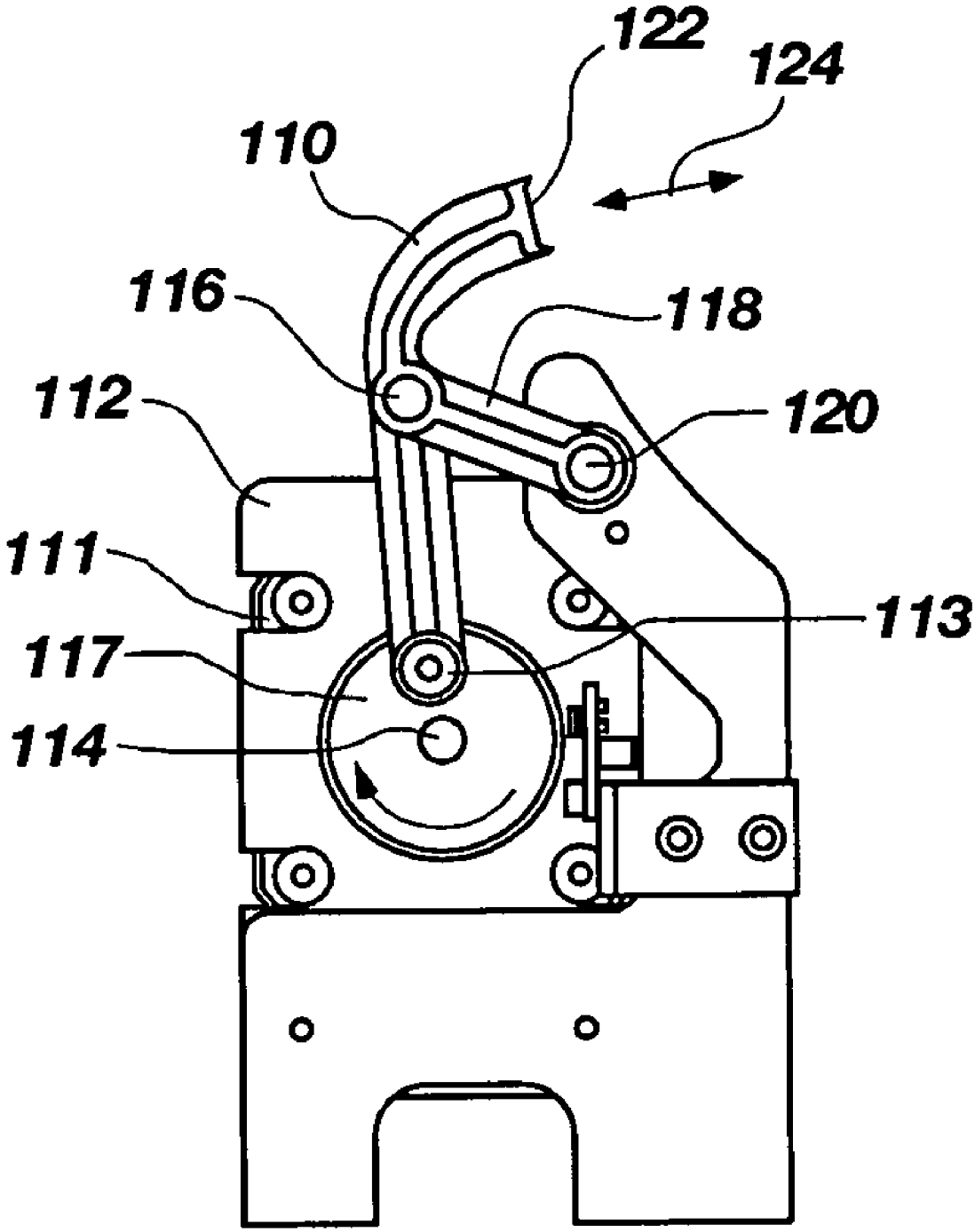
FIG. 4 is a detailed view of a packer arm assembly.

Referring back to FIG. 2, cards move along a card path until being inserted into an aligned compartment 88. In a shuffling mode, the microprocessor randomly assigns a compartment to each card being inserted in the pack of cards. Once the card 48 leaves the adjacent roller pair 72, 73, additional means are provided to overcome the force of leaf spring 92 and fully insert a card. Packer arm 110 proximate advancing roller pair 72, 73 provides this needed force. A detailed side elevational view of packer arm 110 from the opposite side is shown in FIG. 4. A motor 111, mounted to the frame 112 of a shuffler (see FIG. 5) rotates shaft 114. Mounted to shaft 114 is an eccentric cam 117. The packer arm 110 is elongated. A first end of the packer arm 110 is pivotally mounted at pivot 113 to the cam 117. At a midpoint of packer arm 110 is located at pivot point 116. A second arm 118 connects the packer arm 110 and pivot point 116 to the frame 112 at pivot point 120.

In operation, when the motor is energized, shaft 114 rotates, causing the upper end 122 of packer arm 110 to move back and fourth in directions designated by arrow 124 in an arc-shaped path. The upper end 122 comes into contact with cards present in the aligned compartment 88 (FIG. 2), forcing the cards completely into the compartment 88. As the cam 117 continues to rotate, the packer arm 110 retracts. Typically, the packer arm 110 retracts while the carousel is rotating and extends when the carousel is stationary.

Card Pack Removal

Once the distribution of cards into compartments is complete, according to the programming of the microprocessor, the compartments become available for unloading. Alternatively, as soon as a specified number of cards has been delivered to a compartment, that compartment is available for unloading, even if the other compartments have not been filled. Preferably, available compartments are selected randomly for unloading. Referring back to FIG. 2, the card unloading process is facilitated by means of a card pack removal device 125. The removal device 125 comprises a pivotal swing arm 126 that pivots about horizontal axis 128. The swing arm 126 is equipped with a retractable inwardly projecting tab (going into the paper) at its upper end 130 that extends inwardly into a compartment while the arm is swinging toward the output tray 24, but that retracts when the arm swings back to a resting position near a inner circumference 132 of the compartments. In the extended position, the tab contacts the cards. The swing arm is driven by a stepper motor 134, having a rotational shaft 136 supporting pulley 138. Two idler pulleys 137, 139 are also mounted for rotation on the support frame 112. Endless member 140 contacts pulleys 137, 138 and 139 and is securely attached to the swing arm 126 at point 142 such that when stepper motor 134 is energized, the swing arm moves towards the output tray 24 and moves the group of cards into unloading roller pair 146, 148. The attachment point 142 is a clamp but could be any other known manner of securing a belt to a moving object. The direction of rotation of rotational shaft 136 is reversed to bring the swing arm back to its original position.

The inner tab of the swing arm retracts as it comes into contact with stationary tab 150 mounted to the frame 112.

Card Feed Path

The path of each card or cards leaving a selected compartment is substantially horizontal and above the card infeed path. Cards move out of the compartment aligned with the roller pair 146, 148 and then fall into output tray 24 where the cards are accessible by the end user. A card present sensor 152 is located on the bottom surface of output tray 24 and serves to notify the processor that no cards are present. The processor then responds by signaling the device to deliver another group of cards. After the last group is delivered, the remaining cards in the group or set automatically unload.

Carousel Drive

Figure 5:
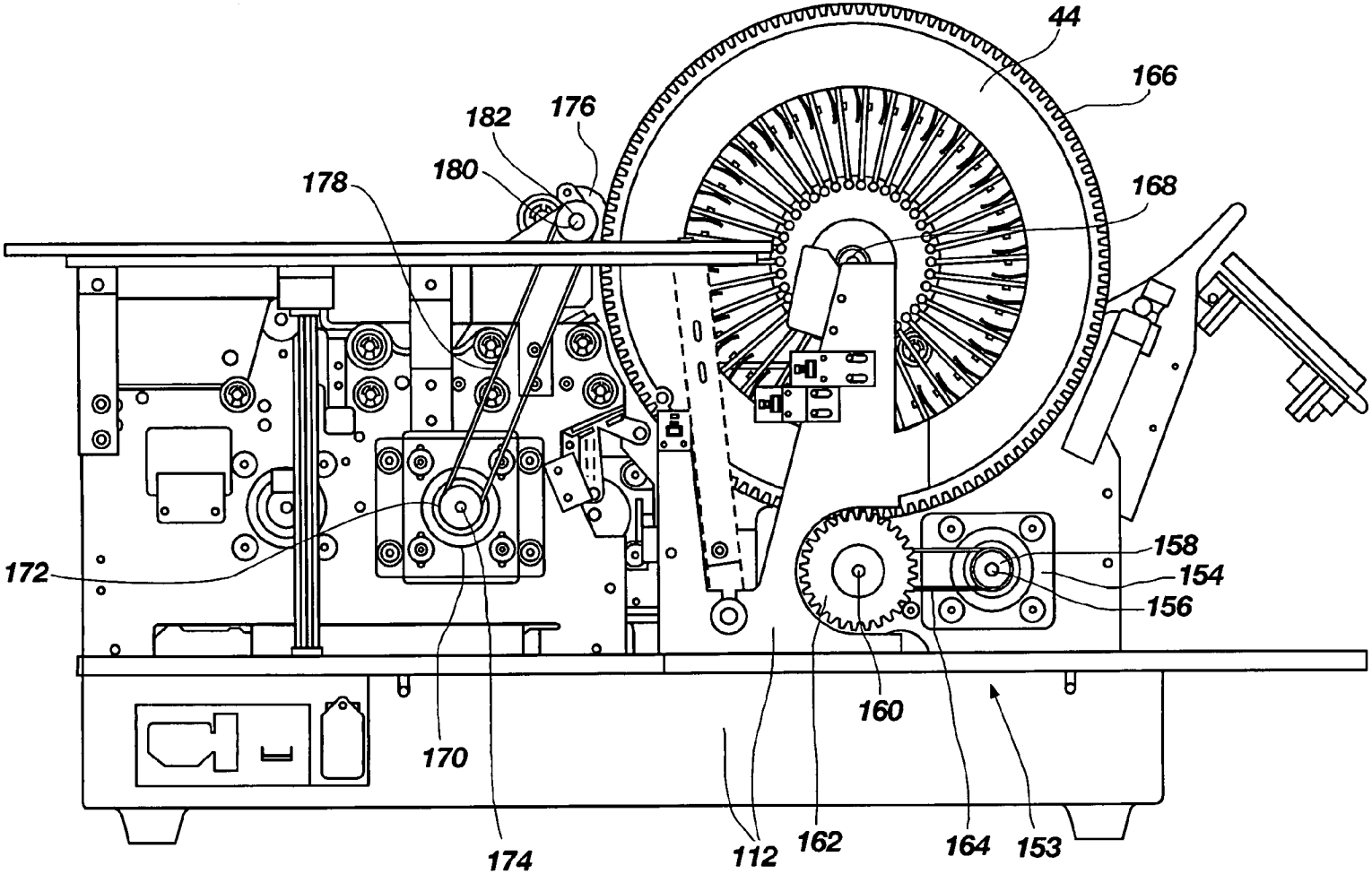
FIG. 5 is a second side elevational view of the shuffler, illustrating the structure of the carousel drive system and the unloading roller pair drive system.

Referring now to FIG. 5, an exemplary drive mechanism for rotating the carousel is illustrated. Pivotally mounted at shaft 168 for rotation with respect to the frame 112 is the carousel structure 44. The carousel structure 44 is preferably mounted for easy removal and replacement such as by means of threaded hand screws or by a locking/release mechanism. The carousel structure 44 is driven in two directions by drive system 153. Drive system 153 includes a motor 154 mounted to the frame 112, a drive shaft 156 and a pulley 158 mounted to the shaft 156. Also mounted to the frame 112 and spaced apart from the motor is driven shaft 160. A pinion gear 162 is fixedly mounted to the shaft 160. Also mounted to the driven shaft 160 is a pulley (not shown). This pulley, as well as the drive shaft pulley 158, contacts endless member 164 to cause rotation of pinion gear 162. The pinion gear 162 meshes with the toothed edge 166 of the carousel structure 44 to cause rotation of the carousel about the axis of the shaft 168.

Card Unloading Roller Pair Drive

The roller pair 146, 148 as shown in FIG. 2 is driven by motor 170 affixed to the frame 112. A pulley 172 is affixed to the shaft 174 of the motor 170, driving unloading roller pair 146, 148. On an opposite side of the device are meshing gears 176 that cause roller pair 146, 148 to be driven in unison. Endless member 178 contacts pulley 180 on shaft 182 supporting roller 146. When motor 170 is energized, roller pair 146 and 148 rotates to move and deposit a card or a group of cards (whatever is in the compartment) into the output tray 24.

Example II of a Carousel Drive Mechanism

Figure 6:
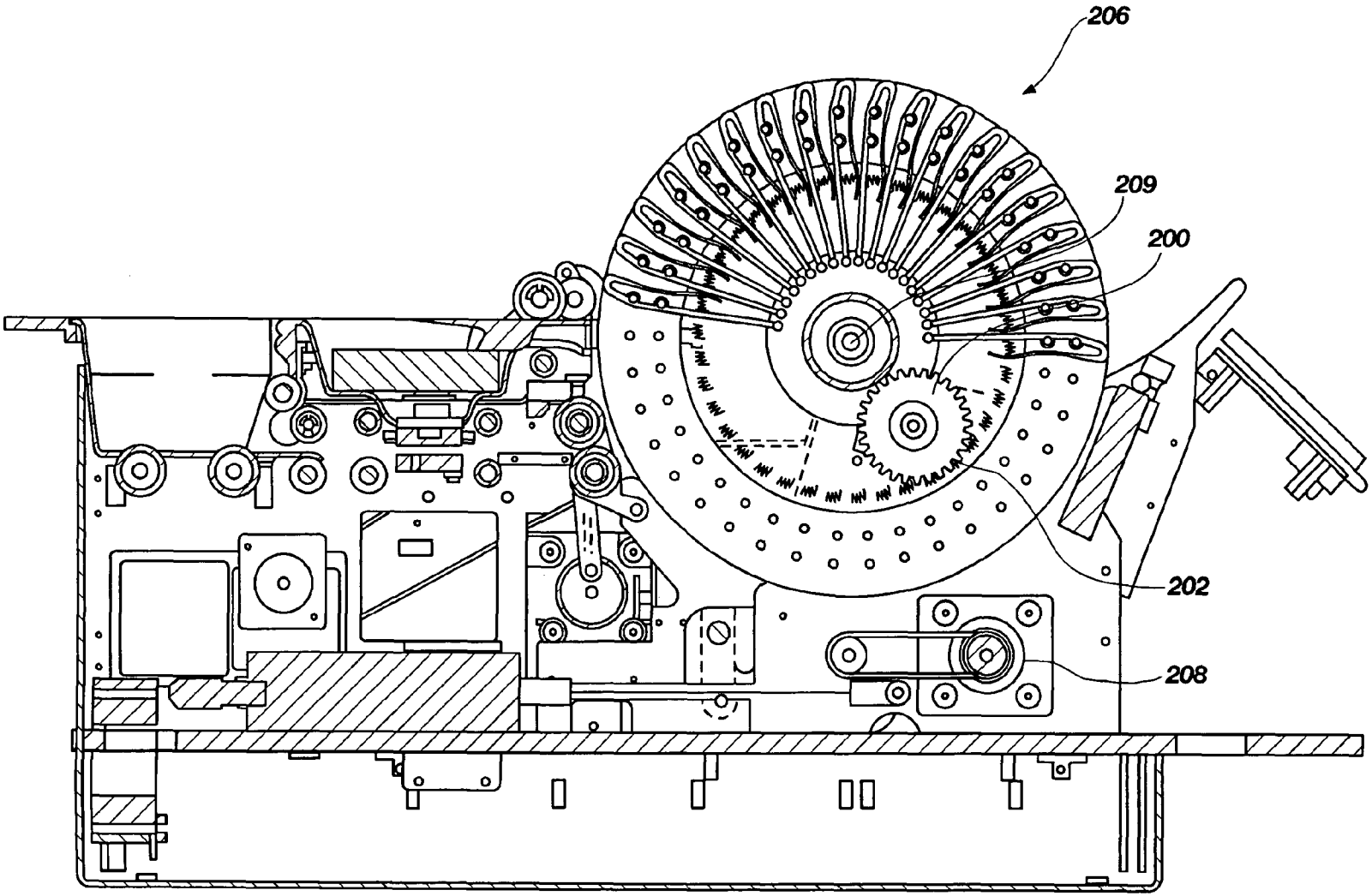
FIG. 6 is a side elevational view of a second embodiment of the shuffler, illustrating an alternate carousel drive system.

In another example of the invention, as shown in FIG. 6, a pinion gear 200 is mounted on a toothed inner race 202 on the carousel 206. A drive motor 208 drives the pinion gear 200 in a conventional manner causing the carousel 206 to rotate about shaft 209. Drive motor 208 drives shaft 209 in a forward and reverse direction during at least one of shuffling, during loading and during unloading.

Card Infeed Tray Gate

Figure 7:
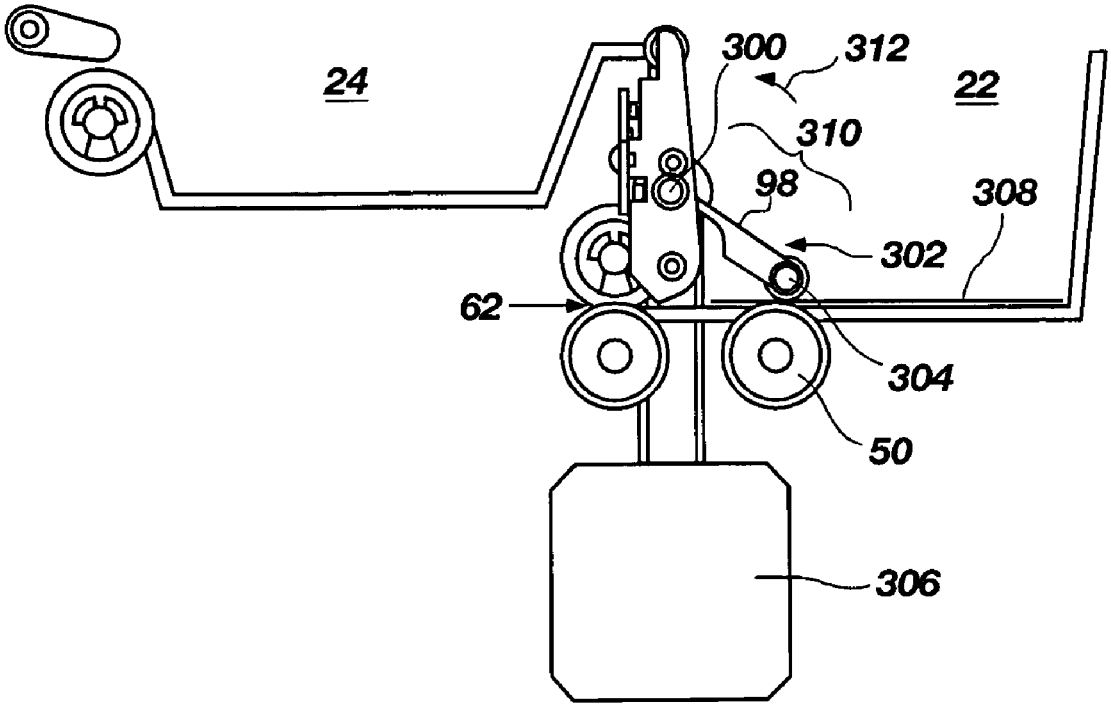
FIG. 7 is a schematic view of the card infeed tray, card feed roller and a dual function gate.

Referring now to FIG. 7, a pivotal gate 98 is provided within the card infeed tray 22. The gate advantageously serves a number of important functions. The gate 98 preferably extends a length (from side-to-side of the machine) of the card infeed tray 22 and pivots about pivotal axis 300 from a first upright and retracted pivotal position (not shown) to a second downwardly angled engaged position 302. At an edge opposite the pivotal axis 300 is a roller 304 whose purpose is to reduce frictional contact with cards in the infeed tray 22. As the number of cards in the infeed tray 22 is reduced, the weight of the cards is lessened, reducing the frictional forces between the lowermost card in the card infeed tray 22 and the feed roller 50. One example of the device adjusts a force on the cards to increase as the number of remaining cards decreases, resulting in a constant force applied to the lowest card. The gate 98 provides additional weight against the cards, improving the frictional contact and assuring the last few cards will be taken into the first nip 62.

The second important function of the pivotal gate 98 is that it provides a physical separation barrier between cards belonging to different decks, or between different types of cards (such as regular cards and bonus cards, for example). When cards remain in the infeed tray 22 and the shuffler is actively taking in cards for shuffling, the gate is in the down position. At the same time, the dealer may be collecting spent cards from the table. Because the gate is in the down position, the dealer can put the spent cards from the deck in play (deck A) on the top of the gate, while the unfed cards from the other deck (deck B) are being fed. Embodiments of the present invention allow the user to load cards from a first deck while feeding cards from a second deck. The gate 98 permits the casino to eliminate the physical discard rack that is typically mounted on the gaming surface, since spent cards can now be placed directly into the infeed tray 22. Once the last of the cards from deck B are fed, the gate rotates about axis 300, releasing the cards previously suspended above the gate 98 to the area below. In the retracted position, the gate 98 does not obstruct the user from inserting additional cards. Another aspect of the gate design is the relative positioning of the pivotal axis 300 relative to the base 306 of the card infeed tray 22, as well as the length of the gate 98 with respect to the width of the cards. The pivotal axis 300 is below an upper surface of the infeed tray 22 in order to remain clear of the end user. The axis is spaced apart from the lower surface 308 of the infeed tray 22 so that an entire deck (or multiple decks) of cards can be received in the infeed tray 22. The length 310 is short enough so that the cards will lift as the gate 98 pivots upwardly (arrow 312) and then release and fall without flipping over cards in the infeed tray 22. A preferred gate length is about one-third the width of the cards. A stepper motor (not shown) located in base 306 drives the rotation of the gate 98 in a conventional manner.

Imaging System

Figure 8:
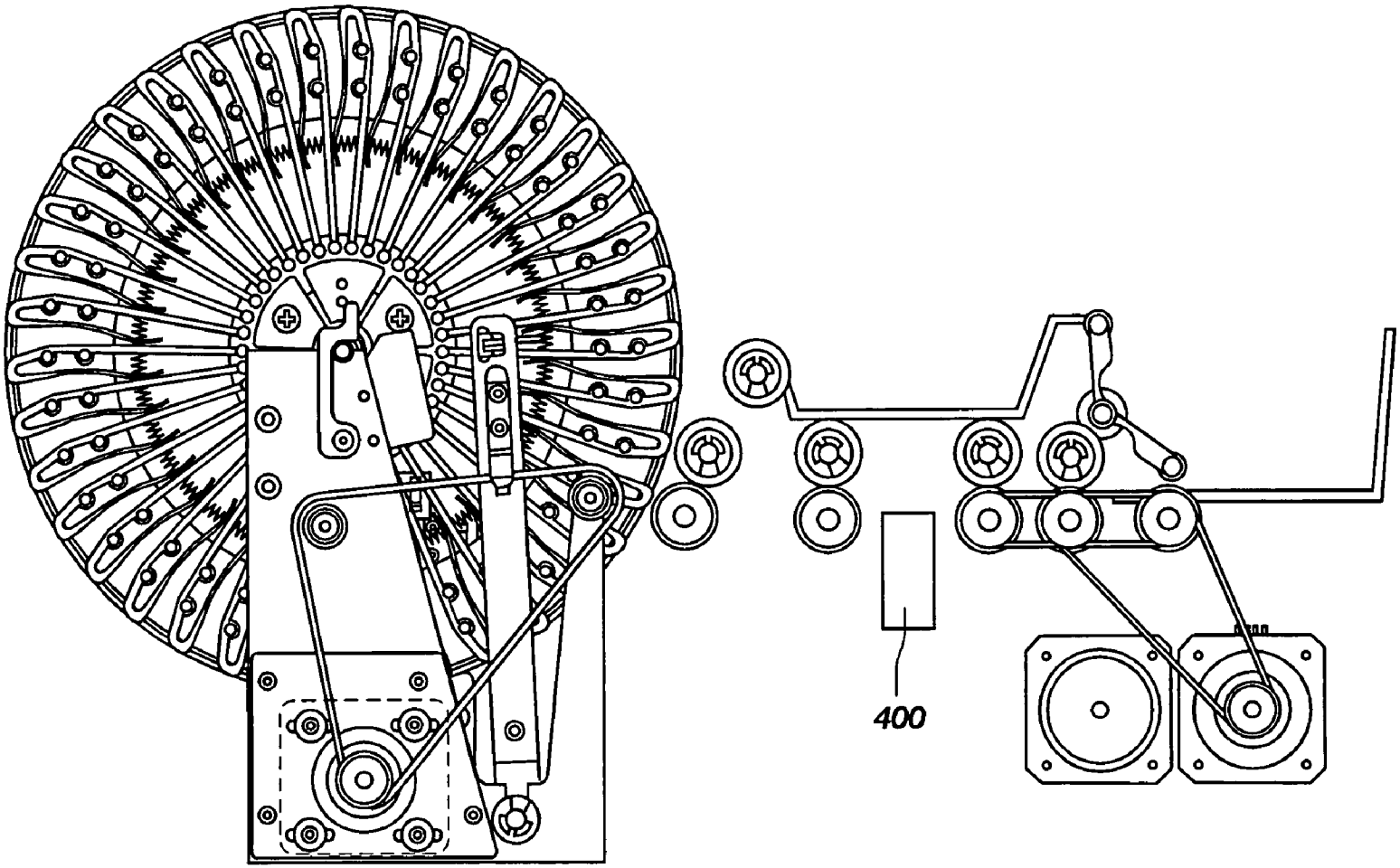
FIG. 8 is a schematic view of an embodiment of the present invention, illustrating one location for a card sensing system.

A schematic diagram of a card handling system equipped with card recognition hardware and software including a sensor 400 is shown in FIG. 8. An exemplary card sensing device is a video camera imaging system of the type described in U.S. Patent Publication US 2004/0067789A1, application Ser. No. 10/623,223, filed Jul. 17, 2003, now U.S. Pat. No. 7,677,565, issued Mar. 16, 2010. A desirable set of image capture devices (e.g., a CCD automatic camera) and sensors (e.g., light-emitting devices and light capture devices) is described, although a wide variety of commercial technologies and commercial components are available. One preferred camera is the DRAGONFLY® automatic camera provided by Point Grey Research, Inc., and includes a six-pin IEEE-1394 interface, asynchronous trigger, multiple frame rates, 640×480 or 1024×724 24-bit true color or eight-bit grayscale images, image acquisition software and plug-and-play capability. This can be combined with commercially available symbol recognition software that typically runs on an external computer (not shown). The commercially available image recognition software is trained on card symbols and taught to report image patterns as specific card suits and ranks. Once a standard card suit/rank recognition program has been developed, the training from one format of cards to another becomes more simply effected and can be done at the casino table or by a security team before the shuffler is placed on the table. Position sensors can be provided and enhanced by one of ordinary skill in the art from commercially available components that can be fitted by one ordinarily skilled in the art. For example, various optics such as SICK® WT2S-N111 or WL2S-E11; OMRON® EE-SPY302; or OPTEK® OP506A, may be used. A useful encoder can be purchased as US Digital encoder 24-300-B. An optical response switch can be provided, such as MICROSWITCH™ SS541A.

Other sensing systems such as the CIS contact imaging systems with FPGA control logic as disclosed in U.S. application Ser. No. 11/417,894, filed May 3, 2006, titled "Manual Dealing Shoe with Card Feed Limiter," now U.S. Pat. No. 7,593,544, issued Sep. 22, 2009, may also be advantageously incorporated and used as a card sensing module. This type of system is small enough to be incorporated into the structure of the shuffler without the addition of an external computer for image processing.

Yet other sensing devices such as bar code readers, magnetic strip readers, object presence sensors, optical sensing devices, sensors for reading near IR and IR wavelengths, sensors for sensing cuts, abrasions, bends, dirt, debris, color, thickness, reflectivity, mass or any other sensor useful in the art of card handling can be utilized as a part of the card handling devices of the present invention.

Bonusing System

One aspect of the present invention is to provide a card handling device capable of dispensing bonus or promotional cards used to provide a prize, incentive or compensation to a player. According to the invention, promotional cards are either inserted into designated compartments within the machine manually by removing the cover, or by inserting the cards into the input tray of the shuffler. The shuffler may be preprogrammed to insert the bonus cards into a preselected compartment or compartments. Typically only one bonus card is placed in a compartment, and a limited number of compartments (such as six to eight, for example) are designated as bonus compartments. Bonus cards may be dispensed in response to events such as a) a jackpot reaching a predetermined amount, b) according to a preselected date and time, c) randomly, d) in response to a game event such as receiving a royal flush in a poker game, e) when a player loyalty account reaches a certain balance, f) in response to a signal from a back house computer to dispense a card, or by any other means. Any card game player can receive a bonus card, regardless of the type of game. For example, a casino might link together 80 live tables, including blackjack, baccarat, THREE CARD POKER® and other games.

The dispensing of a bonus card to players can occur more or less frequently. A casino may wish to run a "free buffet" promotion for THREE CARD POKER® players during the dinner hour on Saturday nights. The device may be programmed to dispense a bonus card entitling the player to two buffet passes when the player obtains a three of a kind hand. Or perhaps the casino would like to give away a car based on a random bonus event. In this case, a bonusing system with a central server is in communication with all shufflers that dispense bonus cards. When the random event occurs, the bonusing system sends only one signal to a single shuffler to dispense a bonus card. The selected shuffler may be randomly selected or may be selected according to a schedule.

The presence of the gate 98 in the card infeed tray 22 (FIG. 7) allows the casino operator to load a designated number of bonus cards from the card infeed tray 22 either before or after loading regular cards without interrupting game play. Preferably, the display 42 (FIG. 1) provides an indication of when the card shuffler 20 (FIG. 1) is out of bonus cards. In a preferred form of the invention, the bonus card carries a designation (such as a specific marking or color) that is capable of being read by one or more sensors and the processor is capable of keeping track of the number of bonus cards left in the machine.

Control System

Figure 9:
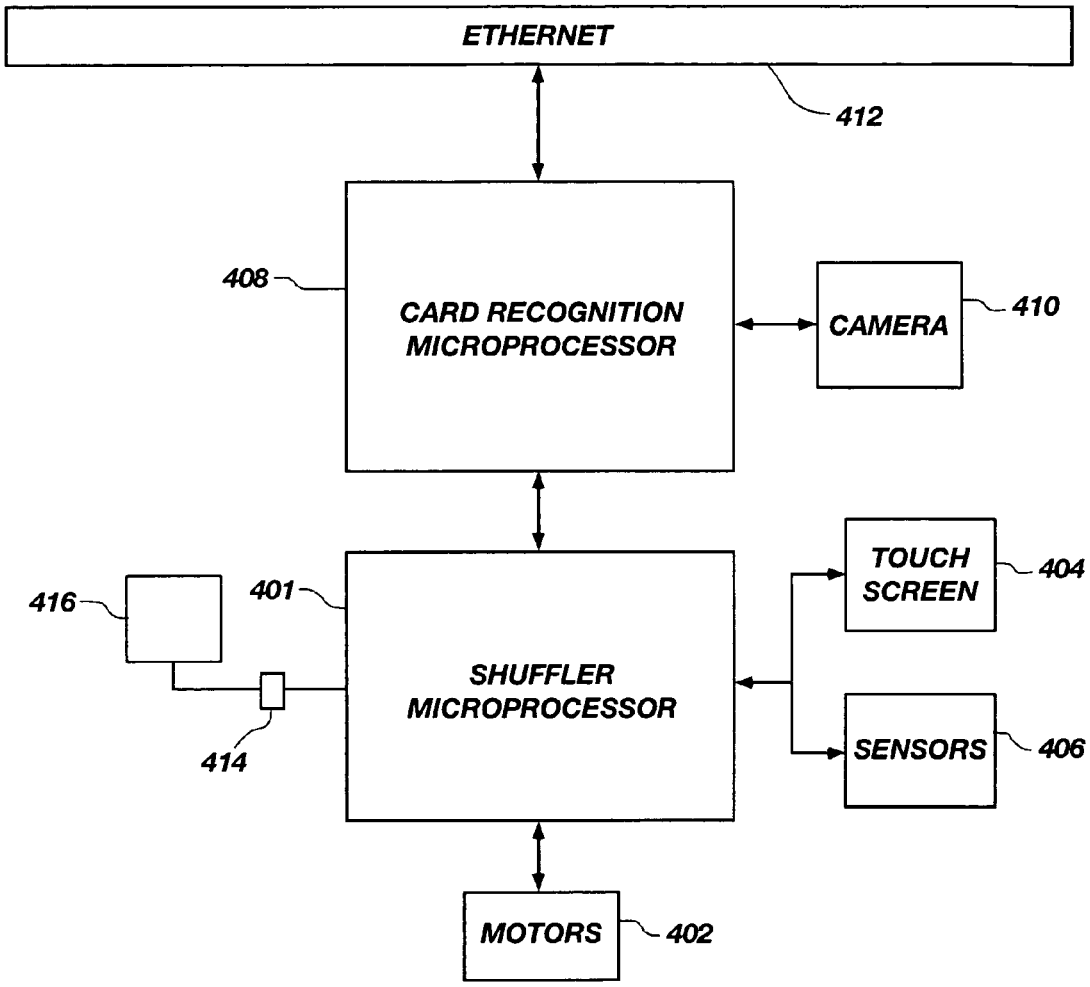
FIG. 9 is a schematic diagram of a control system for one embodiment of the present invention.

Referring now to FIG. 9, a schematic block diagram of an exemplary control system is shown. Preferably, the entire control system is located within the playing card shuffler 20 (FIG. 1). In other forms of the invention, an external computer is provided to perform functions such as image processing, bonus system management, network communication and the like.

Central to the control of the preferred card handling system is a shuffler microprocessor 401. The microprocessor 401 controls all functions of the shuffler, including operation of electrical devices such as motors 402, controlling the images displayed on the display 404 (which may comprise a touch screen), processing signals received from all internal sensors 406 such as optical object presence sensors, motion sensors and the like. The display 404 includes touch screen controls and is further a user interface for programming the microprocessor 401 to display additional game names and to dispense cards according to user inputted data.

A card recognition microprocessor 408 is shown as a separate processing component but could be integrated into the shuffler microprocessor. The card recognition microprocessor 408 interprets signals received from a camera 410 to determine rank and or the suit of a card being read.

Network Capability

As mentioned above, the device of the present invention is at least capable of recognizing the presence of cards, counting cards, and reading rank and suit information. As each card is passed from the card infeed tray into the shuffling compartment, the completeness of the deck may also be verified. In the event a card is missing or extra cards are present, a warning signal is displayed on the display or optionally an alarm signal is sent via a network connection to a pit management computer.

The shuffler microprocessor 401 and the card recognition microprocessor 408 (either individually or as a combined processor) include a network connection and are capable of sending and receiving information on a local network 412 such as an Ethernet.

In the example shown in FIG. 9, only the card recognition microprocessor communicates with the network. The shuffler itself may send and receive information related to needed maintenance or repair. The Ethernet may also collect and/or process data from other data collection devices on a gaming table such as RFID wager amount sensors, object sensors, chip tray inventory sensors, and the like. Data may be collected on the table and sent to a distal database for later analysis and processing, or may be analyzed in real time.

The card handling device of the present invention may include a data port 414 in communication with the shuffler microprocessor 401, card recognition processor 408, or both. This communication port can output information directly to a separate printer 416 or a printer may be incorporated into the shuffler itself.

Other Functions

Card handling devices of the present invention are capable of performing a variety of functions not known prior to this invention. For example, the device may be configured to access a wireless or wired communication network and communicate information to the equipment supplier or user relating to maintenance, repair, machine serial number, current or past operation, performance or usage.

The card handling device may also be programmed to operate in multiple modes (i.e., setup, run, service) and switch between modes without powering down.

Further, the shuffler may be programmed to run a self-diagnosis when either the shuffler is in a service mode and a user inputs a request for a self-diagnosis, or when a single card is fed into the shuffler and creates a report of the function of all operational elements. This information can be sent to a printer attached to the shuffler or incorporated into the shuffler.

The above examples of the present invention are meant to be non-limiting. Many other variations of the invention are possible. For example, providing a card handling zone capable of deck verification only, capable of ordering cards, capable of decommissioning cards, and the like, is clearly contemplated. Numerous card reading systems and schemes can be used in place of the disclosed sensing systems. The touch screen display may be used to input any information needed to program the shuffler for use in a casino. Furthermore, many different arrangements of data collection and analysis hardware and software may be used in connection with the shuffler of the present invention to gain information relating to player performance and win/loss information on a casino game.

What is claimed is:

1. A playing card handling device having a first side and a second opposite side, comprising:

a card infeed tray, a card output tray; and a card handling zone, wherein an upper edge of the card infeed tray and an upper edge of the card output tray are in the same plane and wherein the card infeed tray, the card output tray and the card handling zone are physically arranged in a linear arrangement extending from the first side of the device to the second opposite side of the device, the card output tray and the card infeed tray positioned on the same first side of the device and the card handling zone positioned on the second opposite side of the device.

2. The playing card handling device of claim 1, wherein the card handling zone comprises a card shuffling zone.

3. The playing card handling device of claim 2, wherein the card shuffling zone comprises a carousel with compartments for receiving playing cards.

4. The playing card handling device of claim 2, wherein the card shuffling zone comprises a rack with compartments for receiving playing cards.

5. The playing card handling device of claim 2, wherein the card shuffling zone comprises a fan with compartments for playing cards.

6. The playing card handling device of claim 2, wherein the card shuffling zone comprises a random ejection system for playing cards.

7. The playing card handling device of claim 1, wherein the card infeed tray comprises a movable gate, the gate capable of providing a physical separation of cards being fed and cards being returned to the playing card input compartment after play.

8. The playing card handling device of claim 1, wherein the upper surfaces of the card infeed tray and the card output tray are surface mounted on a gaming table surface.

9. The playing card handling device of claim 1, wherein there is a transportation path for movement of playing cards from the infeed tray to the playing card handling zone, and wherein the path passes underneath the output tray.

10. The playing card handling device of claim 9, wherein the transportation path is substantially linear.

11. The playing card handling device of claim 1, further comprising a display with touch screen controls, the display displaying information and the touch screen controls for inputting information.

12. The playing card handling device of claim 11, wherein the touch screen controls are used to program the card handling system.

13. The playing card handling device of claim 12, wherein the commands comprise at least one of the group consisting of: a number of table positions, a number of cards per hand, a number of dealer cards, a number of common cards, a number of bonus cards, a number of cards per deck and a game name.

14. The card handling device of claim 1, wherein the card handling zone comprises a card shuffling mechanism; and further comprising a processor, wherein the processor is programmed to perform a diagnostic routine in response to the insertion of at least one card.

15. The card handling device of claim 14, wherein the diagnostic routine is performed in response to the insertion of a first card into the card infeed tray.

16. The card handling device of claim 1, wherein the card handling zone is a carousel and further comprises a carousel cover.

17. The card handling device of claim 16, wherein the cover is removable.

18. The card handling device of claim 17, wherein the cover comprises a lock.

19. The card handling device of claim 18, wherein the lock is a mechanical lock.

20. The card handling device of claim 1, wherein the card output tray is positioned between the card infeed tray and the card handling zone.

21. The card handling device of claim 1, wherein an upper portion of the card handling zone is above the plane of the upper edge of the card infeed tray and the upper edge of the card output tray.

* * * * *